US009791253B2

(12) United States Patent
Rothenbuhler et al.

(10) Patent No.: US 9,791,253 B2
(45) Date of Patent: Oct. 17, 2017

(54) RFD WITH HISTORY LOG, SECURITY FENCE, AND SEISMIC DETECTION

(71) Applicant: Rothenbuhler Engineering Co., Sedro-Woolley, WA (US)

(72) Inventors: Neal Howard Rothenbuhler, Sedro-Woolley, WA (US); Richard Blocker Taft, Sedro-Woolley, WA (US)

(73) Assignee: Rothenbuhler Engineering Co., Sedro-Woolley, WA (US)

( * ) Notice: Subject to any disclaimer, the term of this patent is extended or adjusted under 35 U.S.C. 154(b) by 280 days.

(21) Appl. No.: 14/589,788

(22) Filed: Jan. 5, 2015

(65) Prior Publication Data

US 2015/0192396 A1 Jul. 9, 2015

Related U.S. Application Data

(60) Provisional application No. 61/924,163, filed on Jan. 6, 2014.

(51) Int. Cl.

| | |
|---|---|
| ***F42D 1/055*** | (2006.01) |
| ***F42D 1/05*** | (2006.01) |
| ***F42C 13/04*** | (2006.01) |
| ***F42D 5/00*** | (2006.01) |

(52) U.S. Cl.

CPC ..... *F42D 1/05* (2013.01); *F42C 13/04* (2013.01); *F42D 5/00* (2013.01)

(58) Field of Classification Search

CPC ..... F42D 1/05; F42D 5/00; F42C 13/04

See application file for complete search history.

(56) References Cited

U.S. PATENT DOCUMENTS

| | | | | |
|---|---|---|---|---|
| 3,914,732 | A * | 10/1975 | Brumleve | E21B 43/2635 102/215 |
| 4,576,093 | A * | 3/1986 | Snyder | F42D 1/05 102/200 |
| 5,870,029 | A | 2/1999 | Otto et al. | |
| 6,079,333 | A * | 6/2000 | Manning | F42D 1/05 102/200 |
| 7,021,216 | B1 * | 4/2006 | Dragne | F42D 1/05 102/200 |
| 7,650,841 | B2 | 1/2010 | McClure et al. | |
| 8,504,061 | B2 | 8/2013 | Grainger et al. | |
| 2002/0088620 | A1 * | 7/2002 | Lerche | E21B 41/00 166/297 |
| 2006/0027121 | A1 * | 2/2006 | Koekemoer | F42D 1/05 102/301 |

(Continued)

FOREIGN PATENT DOCUMENTS

| | | | |
|---|---|---|---|
| CA | 2 381 651 | A1 | 10/2003 |
| WO | 2009/105243 | A2 | 8/2009 |

OTHER PUBLICATIONS

International Search Report and Written Opinion mailed May 6, 2015, issued in PCT/US2015/010314, filed Jan. 6, 2015, 10 pages.

(Continued)

*Primary Examiner* — Gabriel Klein

(74) *Attorney, Agent, or Firm* — Christensen O'Connor Johnson Kindness PLLC

(57) ABSTRACT

Technical solutions are engineered for remote firing devices to include pieces of hardware to implement a history log, security fence, seismic detection, countdown timers, and sequential firing.

12 Claims, 22 Drawing Sheets

(56) References Cited

U.S. PATENT DOCUMENTS

| | | | | |
|---|---|---|---|---|
| 2007/0277403 | A1 | 12/2007 | Summer | |
| 2008/0028925 | A1 | 2/2008 | Lingemann | |
| 2008/0282925 | A1 | 11/2008 | Lownds et al. | |
| 2010/0005994 | A1* | 1/2010 | Jacobson | F42D 1/05 102/215 |
| 2012/0094638 | A1 | 4/2012 | Shamoon et al. | |
| 2017/0074630 | A1* | 3/2017 | Kotsonis | F42D 1/05 |

OTHER PUBLICATIONS

"SD-500 Radio Remote Blasting System," <http://safetydevicesinc.com/products/SD500C.html> [retrieved Apr. 6, 2015], 3 pages.

* cited by examiner

RFD WITH HISTORY LOG, SECURITY FENCE, AND SEISMIC DETECTION

CROSS-REFERENCE TO RELATED APPLICATION

This application claims the benefit of U.S. Provisional Application No. 61/924,163, filed Jan. 6, 2014, which is incorporated herein by reference.

TECHNICAL FIELD

The present subject matter is generally related to remote firing devices, and more particularly, it relates to technical solutions for better remote firing devices including history log, security fence, seismic detection, countdown timers, and sequential firing.

BACKGROUND

Explosive devices have differing triggering mechanisms including wire, radio, cellular phone, or infrared. Historically, command-wire uses an electrical firing cable that affords the user complete control over the device right up until the moment of initiation. In modern times, the trigger is radio-controlled by a radio link. The system is constructed so that a receiver is connected to an electrical firing circuit and the transmitter operated by the operator at a distance. A signal from the transmitter causes the receiver to trigger a firing pulse that operates a switch. Usually the switch fires an initiator; however, the output may also be used to remotely arm an explosive circuit. In conventional systems, it is impossible to tell what has transpired in connection with an explosion. Additionally, there is a desire to delimit the operations of the system to improve safety.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

One aspect of the present subject matter is in a system form which recites a system comprising a controller, the hardware of which is suitable for being communicatively coupled with a piece of controller event hardware which is capable of logging events; and a piece of controller security fence hardware having a capacity to enforce a first security fence within which operations of the controller are allowed. The system also comprises a remote, the hardware of which is suitable for being communicatively coupled with a piece of remote event hardware which is capable of logging events; a piece of remote security fence hardware having a capacity to enforce a second security fence within which operations of the remote are allowed; and a piece of seismic detection hardware which is suitable for detecting seismic vibration.

Another aspect of the present subject matter is in an apparatus form which recites a controller comprising a piece of controller event hardware which is capable of logging events; a piece of controller security fence hardware having a capacity to enforce a first security fence within which operations of the controller are allowed; a controller GPS module; and a controller countdown timer.

An additional aspect of the present subject matter is in an apparatus form which recites a remote comprising a piece of remote event hardware which is capable of logging events; a piece of remote security fence hardware having a capacity to enforce a second security fence within which operations of the remote are allowed; a piece of seismic detection hardware which is suitable for detecting seismic vibration; a remote GPS module; a remote countdown timer; and a piece of sequential firing hardware which is capable of causing the remote to fire after another remote has fired.

A further aspect of the present subject matter is in a method form which recites a method comprising allowing operations of a controller if the operations are within a first security fence; allowing operations of a remote if the operations are within a second security fence; detecting seismic vibration after a blast has occurred; storing retrievable events of a controller in a first non-volatile memory; and storing retrievable events of a remote in a second non-volatile memory.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
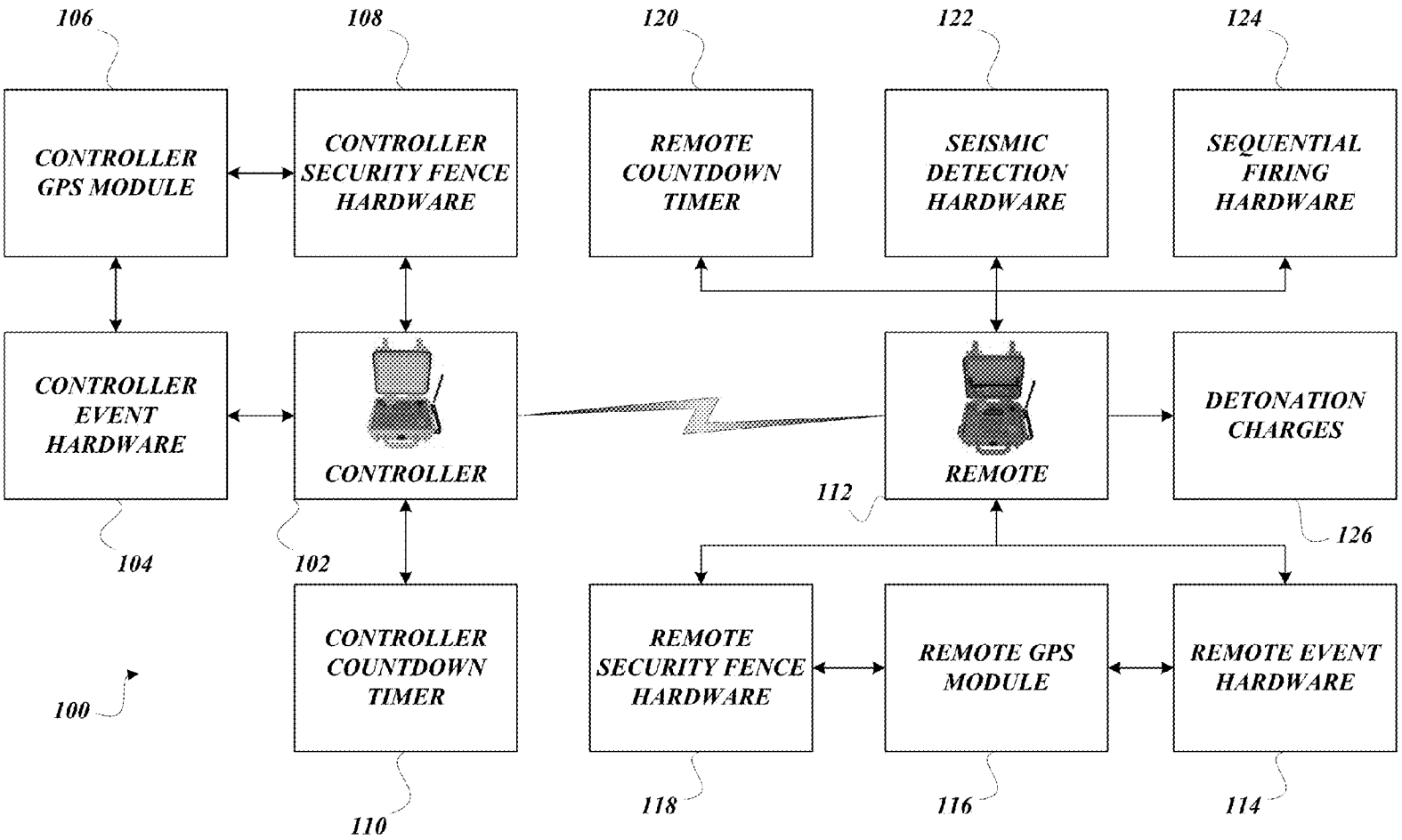
FIG. 1 is a block diagram illustrating archetypical pieces of hardware of a system.

FIG. 1 illustrates a system 100 in which a controller 102 is in wireless communication with one or more remotes 112. The system 100 uses multiple microprocessors to effectuate discrete two-way radio-controlled remote blast initiation. The system 100's signals are digitally encoded (addressed). The system 100 is executed by software running on these multiple microprocessors located in the controller 102 and in the remotes 112. The system 100's message encoding/validation technical solutions have been combined to safely fire multiple dual-output remotes, electric or non-electric, in one or more defined groups. Both the controller 102 and a remote 112 can run on standby power mode for many hours before recharging is required. Both the controller 102 and the remote 112 have each a retractable and guarded antenna, which can be raised vertically during operation and retracted into an antenna guard for protection during transport and storage. The system 100 has increased firing capacity in which a minimum 350 volts are available. LCD displays are installed in both the controller 102 and the remote 112 to display information pertaining to the operation of the system 100.

The controller 102 is communicatively coupled to a piece of controller event hardware 104. The controller event hardware 104 is engineered to log events using GPS information when available. The controller event hardware 104 keeps a record of information such as controller's state, post-blast motion detect value, firing voltage level, battery level, and the date and time the event was logged. With the GPS included, each event includes the longitude and latitude of where the controller 102 was when the event was recorded. The controller event hardware 104 stores the last number of events in non-volatile memory. These events form a history which can be used to obtain information on the operation and performance of the controller 102. Each event is logged with the current date and time and some events also include the GPS coordinates (if GPS is enabled and a signal available when logged). These events can be uploaded to a personal computer through a USB cable to invoke a program. The program reads the data and then converts it to a readable format, such as a spreadsheet format.

The controller 102 also is communicatively coupled to a piece of controller security fence hardware 108. The controller security fence hardware 108 inhibits operations of the controller to arm or to fire outside of the security fence. Other actions such as status request and disarm are not inhibited. The GPS fence can be set up to cover a different area for operations of the controller 102 and a different area of operations for each remote 112. Here is a use case: A user may choose to enable this feature in the controller 102 and allow the remotes 112 to be placed freely. The controller security fence hardware 108 is engineered to provide the following technical solution: the controller 102 can only be fired from an established zone. This can be used to ensure that the operator/blast crew can only fire from a safe position. In the event the controller 102 was lost or stolen, it could not be used outside of the authorized security fence which discourages theft or terrorist use.

Both the controller event hardware 104 and the controller security fence hardware 108 are communicatively coupled to a controller GPS module 106. The controller GPS module 106 stores the date and time for use in the history log regardless of whether a GPS signal is available as long as sufficient battery power is present. The controller GPS module 106 is powered by the controller's main battery when the controller is switched on. When the controller GPS module 106 is switched off, the controller GPS module 106 is powered by a three-volt rechargeable lithium battery and is placed in a low current draw mode which keeps its clock running in order to maintain the correct date and time. The controller's three-volt rechargeable lithium battery keeps the clock running for 7-10 days. To reset the clock or to correct accumulated date and time drift error, the controller GPS module 106 is facilitated to re-acquire a GPS signal. The controller GPS module 106 supports 66 channels with an update rate of up to 10 Hertz. It is capable of SBAS (WAAS, EGNOS, and MSAS). The controller GPS module 106 has fast TTFF at a low signal level. The built-in battery reserve system, in addition to keeping the clock running, is also used for rapid satellite acquisition. The controller GPS module 106 is set to update a processor with fresh GPS data every 500 ms. The processor extracts the date, time, GPS information, and HDOP (horizontal dilution of precision) as provided by the GPS.

The controller 102 is communicatively coupled to a controller countdown timer 110. The controller countdown timer 110 automatically disarms the controller 102 after expiry of a period of time. The automatic-disarming technical function ensures that the controller 102 returns to a safe state in the event of a loss of communications, after a time out period.

The remote 112 is communicatively coupled to a piece of remote event hardware 114. The remote event hardware 114 is engineered to log events using GPS information when available. The remote event hardware 114 keeps a record of information such as remote's state, post-blast motion detect value, firing voltage level, battery level, and the date and time the event was logged. With the GPS included, each event includes the longitude and latitude of where the remote 112 was when the event was recorded. The remote event hardware 114 stores the last number of events in non-volatile memory. These events form a history which can be used to obtain information on the operation and performance of the remote 112. Each event is logged with the current date and time and some events also include the GPS coordinates (if GPS is enabled and a signal available when logged). These events can be uploaded to a personal computer through a USB cable to invoke a program. The program reads the data and then converts it to a readable format, such as a spreadsheet format.

The remote 112 is also communicatively coupled to a piece of remote security fence hardware 118. The remote security fence hardware 118 inhibits operations of the remote to arm or to fire outside of the security fence. Other actions such as status request and disarm are not inhibited. The GPS fence can be set up to cover a different area for operations of the remote 112 and a different area of operations for the controller 102. The remote security fence hardware 118 is engineered to provide the following technical solutions: the remote 112 can only be fired from an established zone. This can be used to ensure that the remote 112 is not placed too close to the blast area where it might be damaged and to help keep the blasting crew a safe distance from the blast area during hookup of the firing line. In the event the remote 112 is lost or stolen, it cannot be used outside the authorized security fence which discourages theft or terrorist use. The security fence is not a physical fence but a virtual one.

Both the remote event hardware 114 and the remote security fence hardware 118 are communicatively coupled to a remote GPS module 116. The remote GPS module 116 stores the date and time for use in the history log regardless of whether a GPS signal is available as long as sufficient battery power is present. The remote GPS module 116 is powered by the remote's main battery when the controller is switched on. When the remote GPS module 116 is switched off, the remote GPS module 116 is powered by a three-volt rechargeable lithium battery and is placed in a low current draw mode which keeps its clock running in order to maintain the correct date and time. The remote's three-volt rechargeable lithium battery keeps the clock running for 7-10 days. To reset the clock or to correct accumulated date and time drift error, the remote GPS module 116 is facilitated to re-acquire a GPS signal. The remote GPS module 116 supports 66 channels with an update rate of up to 10 Hertz. It is capable of SBAS (WAAS, EGNOS, and MSAS). The remote GPS module 116 has fast TTFF at a low signal level. The built-in battery reserve system, in addition to keeping the clock running, is also used for rapid satellite acquisition. The remote GPS module 116 is set to update a processor with fresh GPS data every 500 ms. The processor extracts the date, time, GPS information, and HDOP as provided by the GPS.

The remote 112 is wired to detonation charges 126. The remote 112 is communicatively coupled to a piece of seismic detection hardware 122. The seismic detection hardware 122 is suitably used to detect post-blast vibration. Each remote 112 has a hardware sensor, namely, the seismic detection hardware 122 that measures the seismic motion that is expected when a successful blast detonation has occurred. The controller 102, after being notified by the remote 112, reports that a post-fire vibration was detected, which is useful in subsurface operations when the successful initiation of a blast cannot be easily determined.

The seismic detection hardware 122 is a sensor that measures the seismic vibration that may be expected when a successful blast detonation has occurred. The measured vibration is integrated over a period of time following an attempt at initiation. The vibration value is subsequently returned to the controller 102 through the radio communications link during the post-blast automatic status check. If the motion value is sufficient, the controller 102 reports to the operator that a post-fire motion was detected via a liquid crystal display. The seismic detection hardware 122 is useful in operations where the successful initiation of a blast cannot be easily determined. The seismic detection hardware 122 also helps inform the user of a successful detonation when other methods (sight, sound, and perceived or measured vibration) are not directly available to the user. The seismic detection hardware 122 facilitates knowledge that a blast attempt was not successful to inform the user that re-entry may be dangerous and that he may wish to choose extra precautions, protective gear, and/or extra wait times.

Because the magnitude and frequency of a blast wave is complex, it is characterized by the seismic detection hardware 122 and may affect measurements: the distance from the blast (higher frequencies tend to attenuate more quickly); the type and quantity of the explosive energy; the blast-hole pattern and inter-hole timing; the geological features of the earth materials; whether the body wave consists of the P (or primary) or S (or secondary) wave; and so on. Background noise in the measurement might contribute to a false post-blast indication, so the seismic detection hardware 122 suitably characterizes such background noise. Background noise may be a result of motion or vibration from neighboring equipment such as high power fans, generators, or waves from other nearby blasts.

The remote 112 is communicatively coupled to a piece of sequential firing hardware 124. The sequential firing hardware 124 upon activation allows the user to space the firings of each remote 112 so that they do not fire at the same time (suitably 0-2 seconds between the firing of each remote 112). This feature is particularly useful when firing multiple blocks where a delay is needed between each block to verify successes of operations. The remote 112 is communicatively coupled to a remote countdown timer 120. The remote countdown timer 120 automatically disarms the controller 112 after expiry of a period of time. The automatic-disarming technical function ensures that the remote 112 returns to a safe state in the event of a loss of communications, after a time out period.

Figure 2:
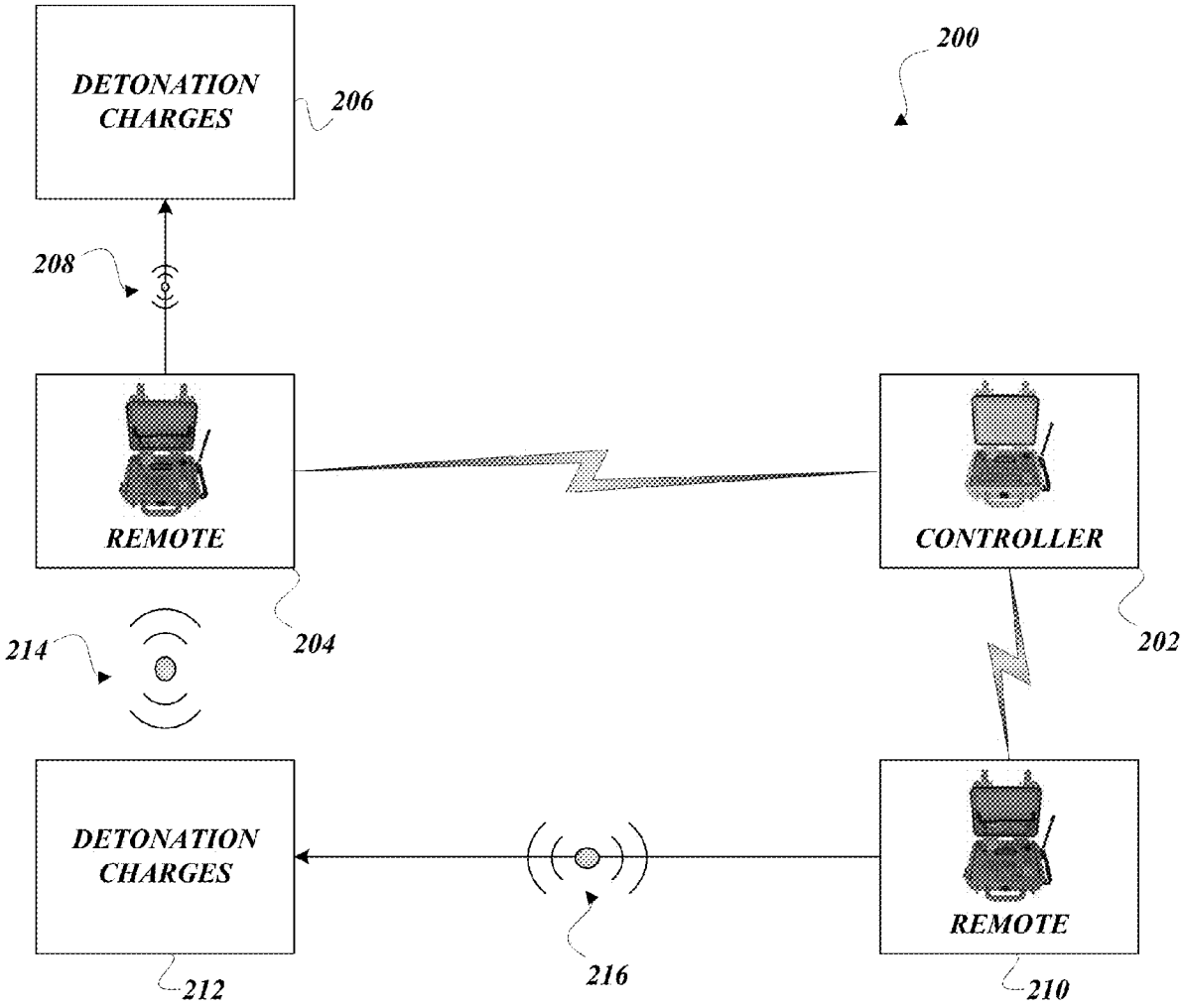
FIG. 2 is a pictorial diagram illustrating a use case using pieces of hardware of the system.

FIG. 2 illustrates a use case scenario 200 in which a controller 202 is in wireless communication with a remote 204 as well as another remote 210. The remote 204 is wire coupled to detonation charges 206. When the controller 202 arms and issues a firing command to the remote 204, the remote 204 detonates the detonation charges 206 generating seismic vibration 208. The controller 202 arms and issues a firing command to the remote 210. The remote 210, in turn, detonates detonation charges 212 generating seismic vibration 214 as well as seismic vibration 216.

Firing multiple blasts at the same time may produce false seismic vibration detections. For example, in FIG. 2, the remotes 204, 210 are fired at the same time. However, the remote 204's blast pattern failed to detonate or had a seismic vibration 208 that was not sufficiently strong when reaching the remote 204. If the proximity of the blast from the remote 210 is sufficiently close, the remote 204 may inadvertently pick up the seismic vibration 214 and report to the user that a successful blast initiation occurred. This gives the user false information that the detonation charges 206 were successfully initiated, which may not have been the case. This false reporting to the user significantly decreases the usefulness of post-blast seismic vibration sensing when using multiple remotes. To reduce this undesired interaction, the user can employ the sequential firing hardware 124. This hardware allows the user to set a delay between the firing of each remote, such as from 0 to 2 seconds. With a delay between the firing of each remote, the vibration detection sampling can be completed for each remote before the next remote initiates its charge. Thus each remote can sample the vibration from its connected blast pattern without interference from neighboring blast patterns. The sequence delay is user programmable in ⅛th second increments and is stored in the non-volatile memory of the controller 102. This delay value is sent to the remotes within the broadcast firing command. Each remote calculates its delay based on the number of lower remotes (lower remote means a remote with an identification number lower than another remote) and waits accordingly. The sequence delay spaces the firing of each remote an equal amount, with the lowest remote firing first, and a subsequent highest remote firing next, until the last remote fires. If a remote within the middle of a group is not selected for firing, its delay is skipped. To prevent false motion detections from adjacent blasts, the delay should be set to be greater than the vibration detection sample period.

Figure 3A:
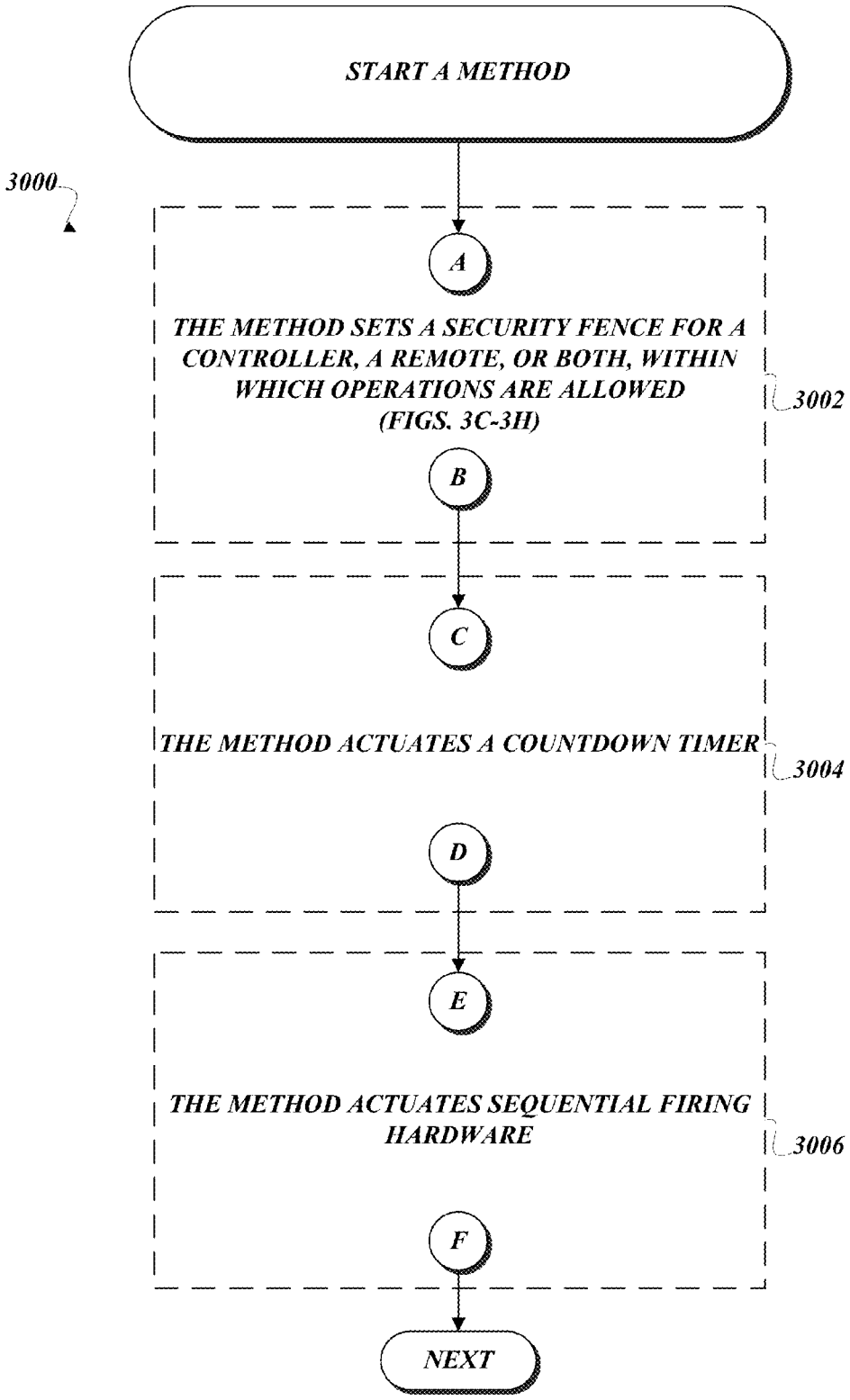
FIGS. 3A-3T are process diagrams implementing an archetypical method.
Figure 3B:
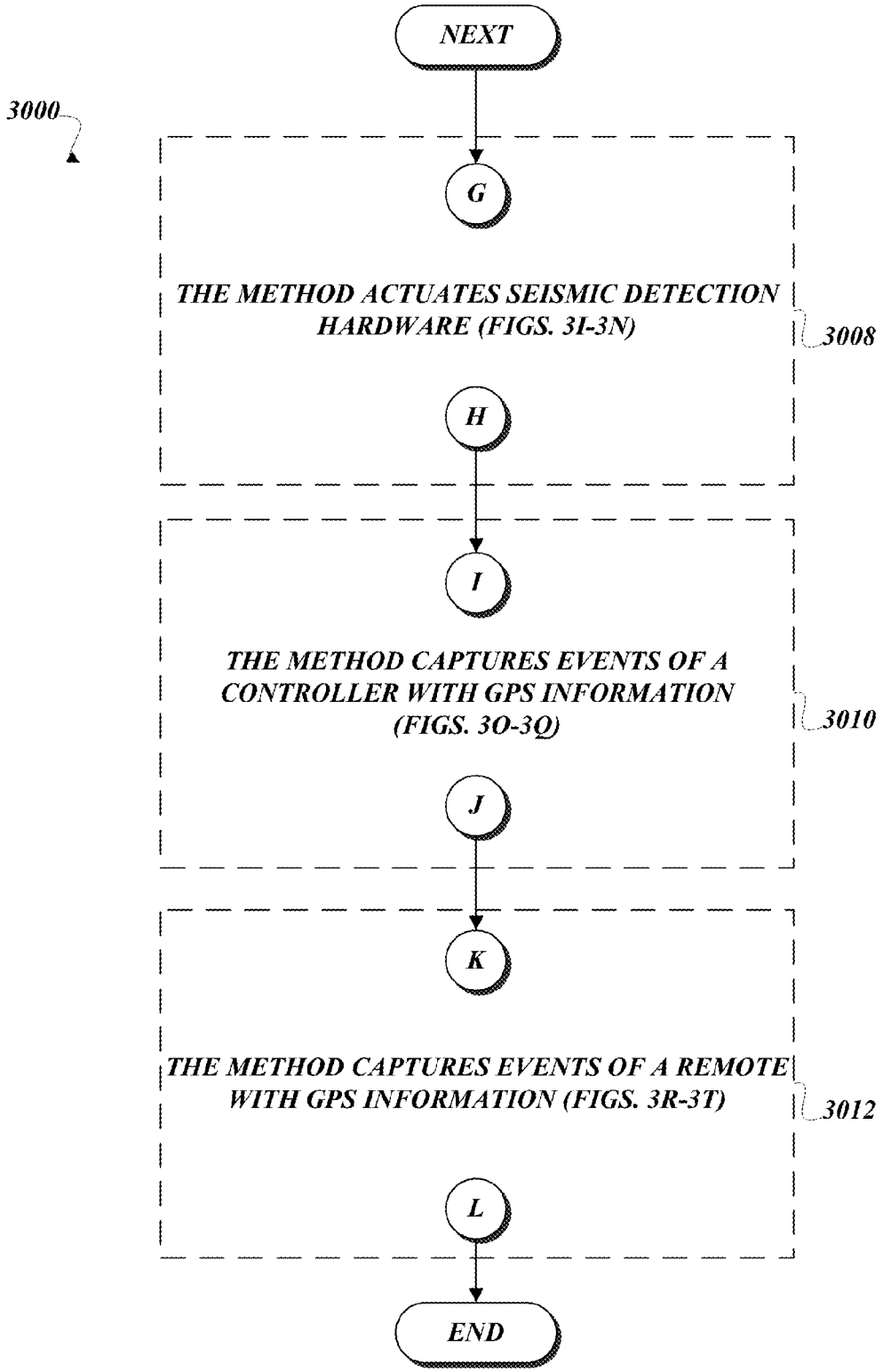
Figure 3C:
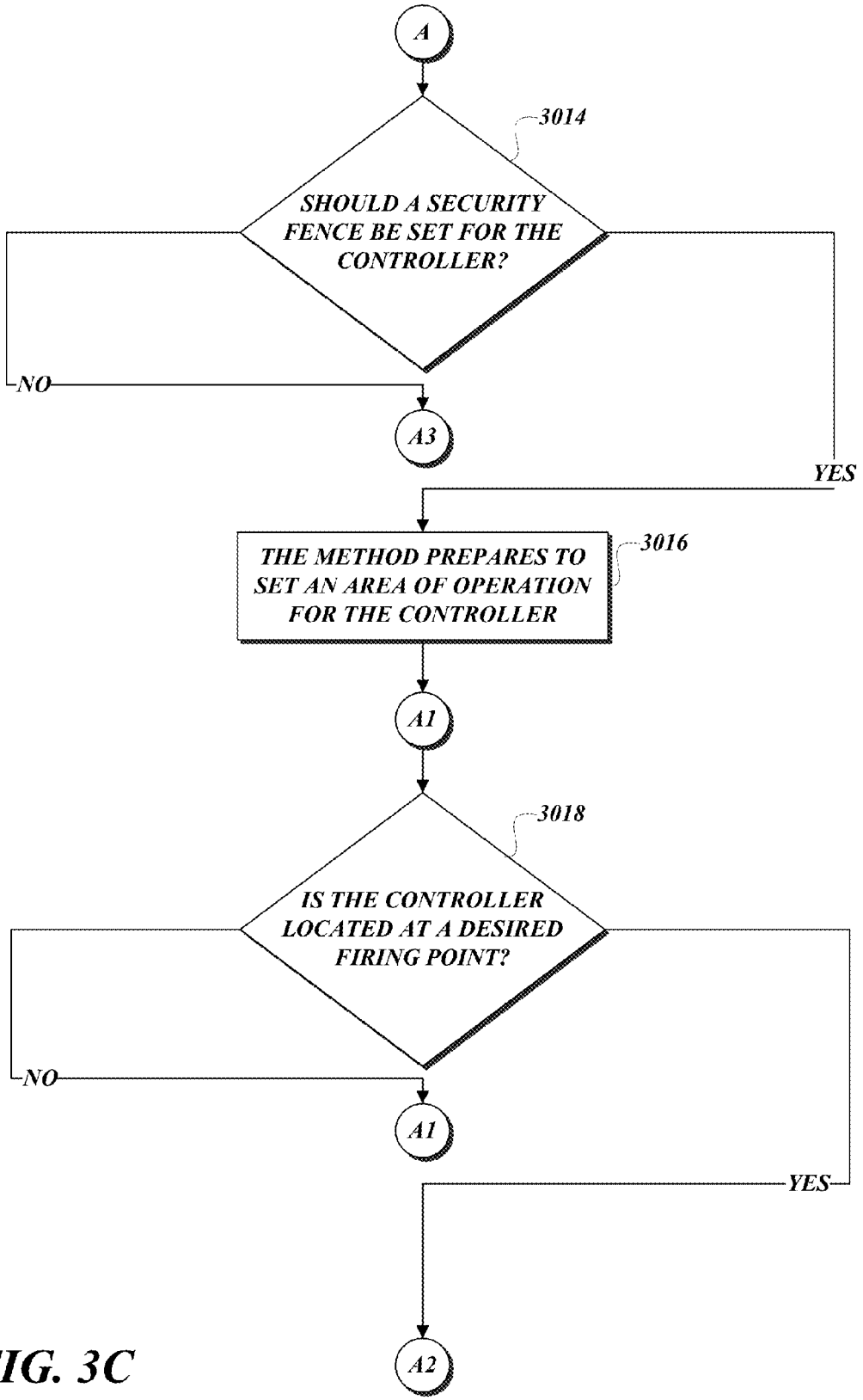
Figure 3D:
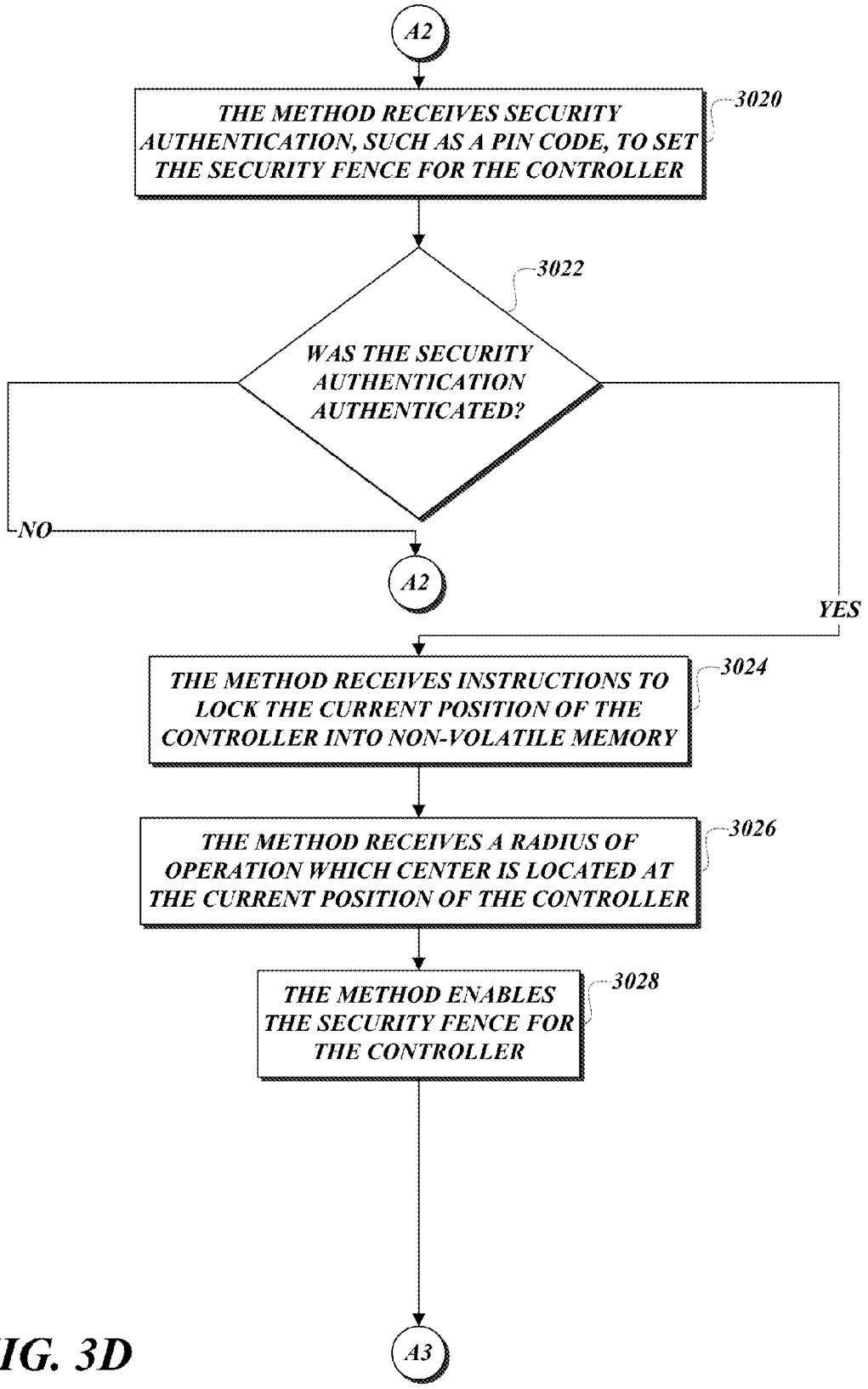
Figure 3E:
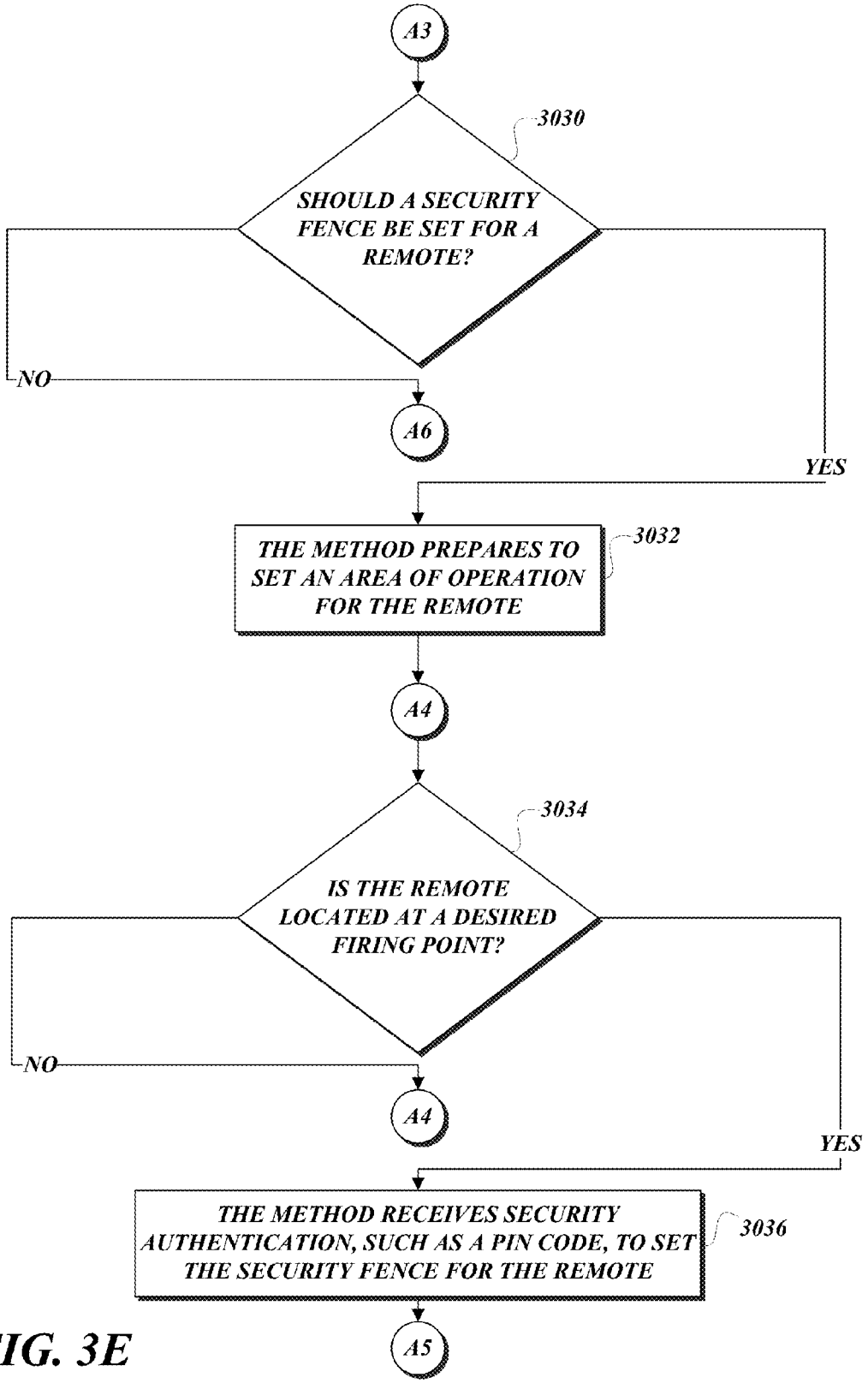
Figure 3F:
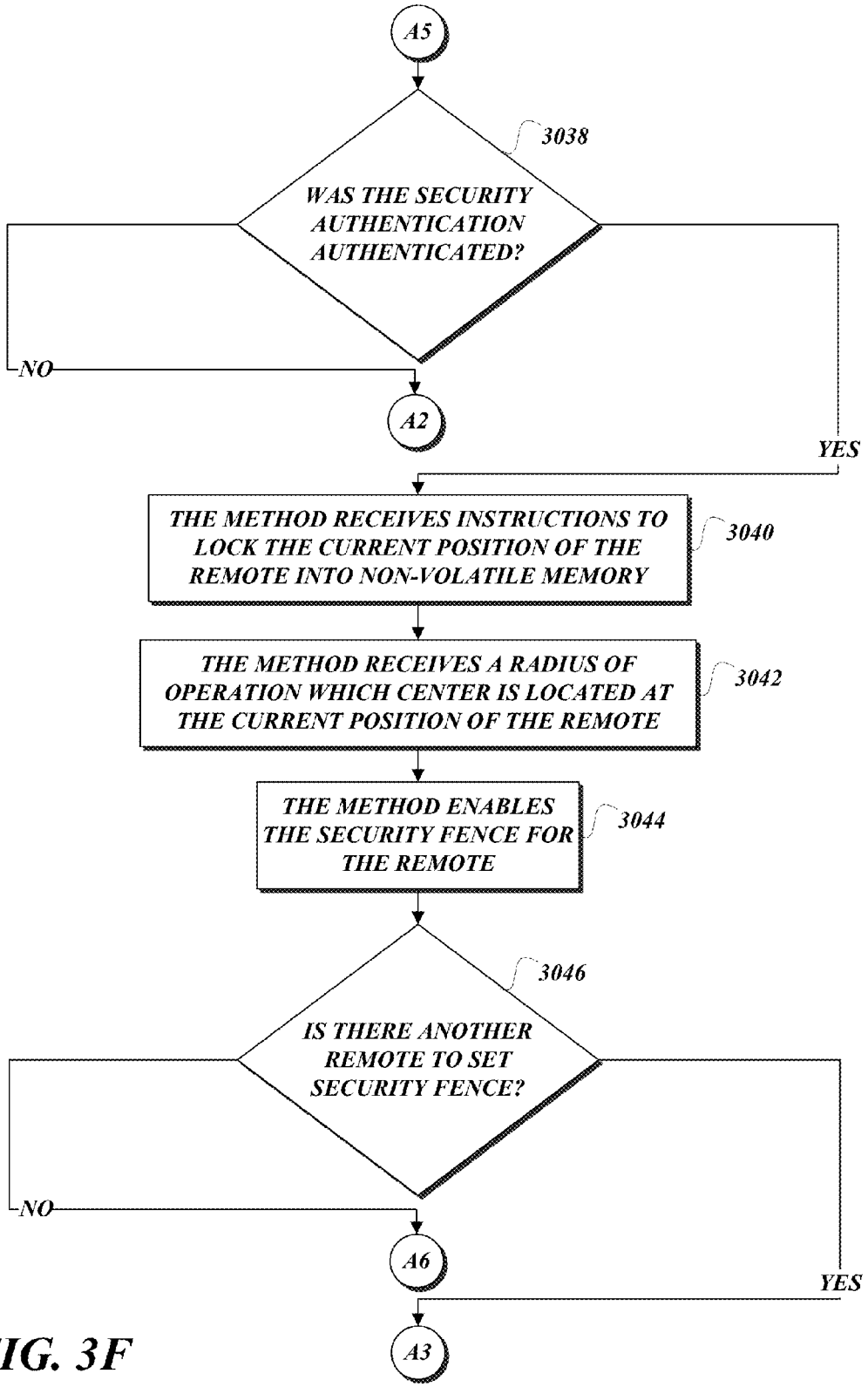
Figure 3G:
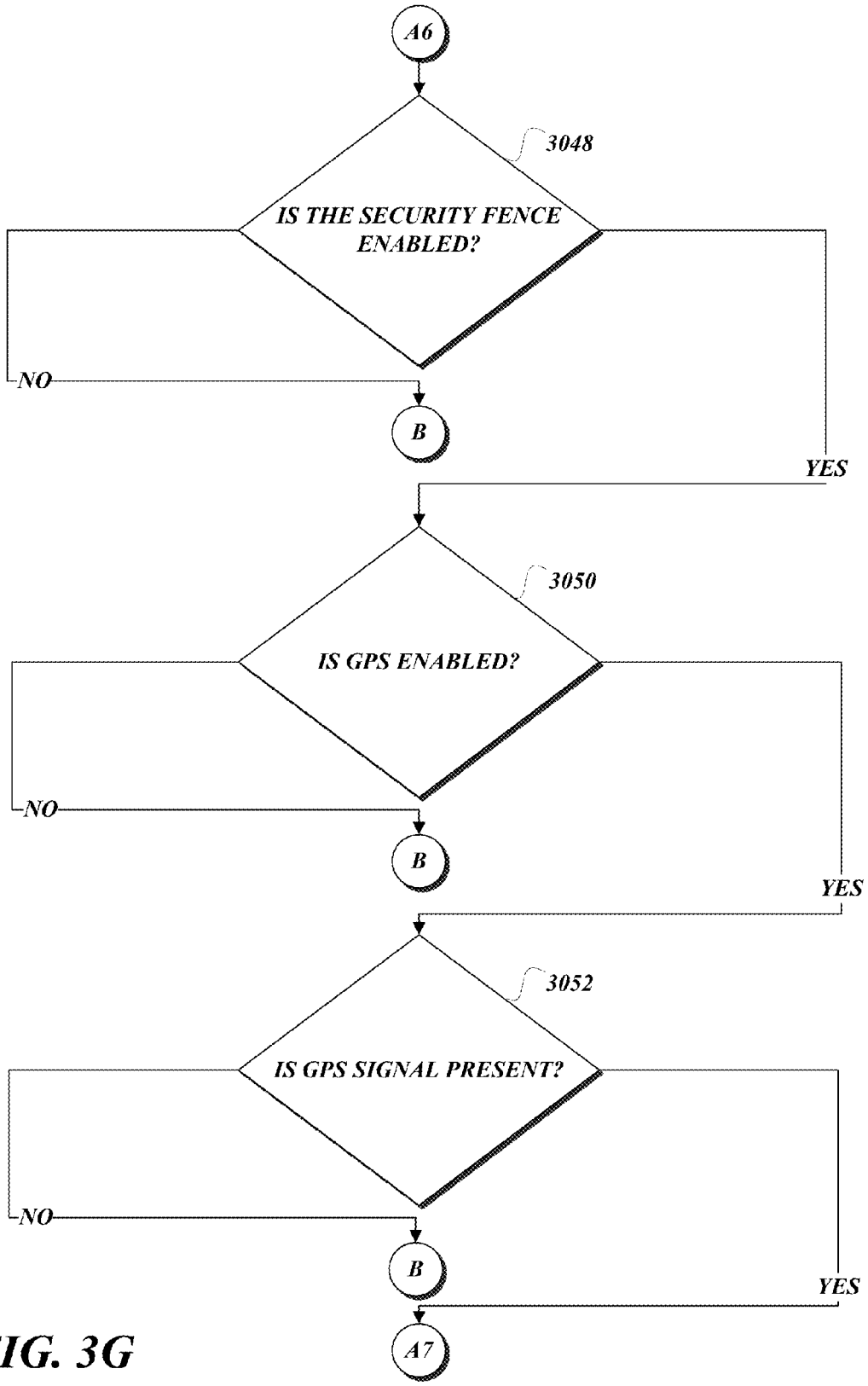
Figure 3H:
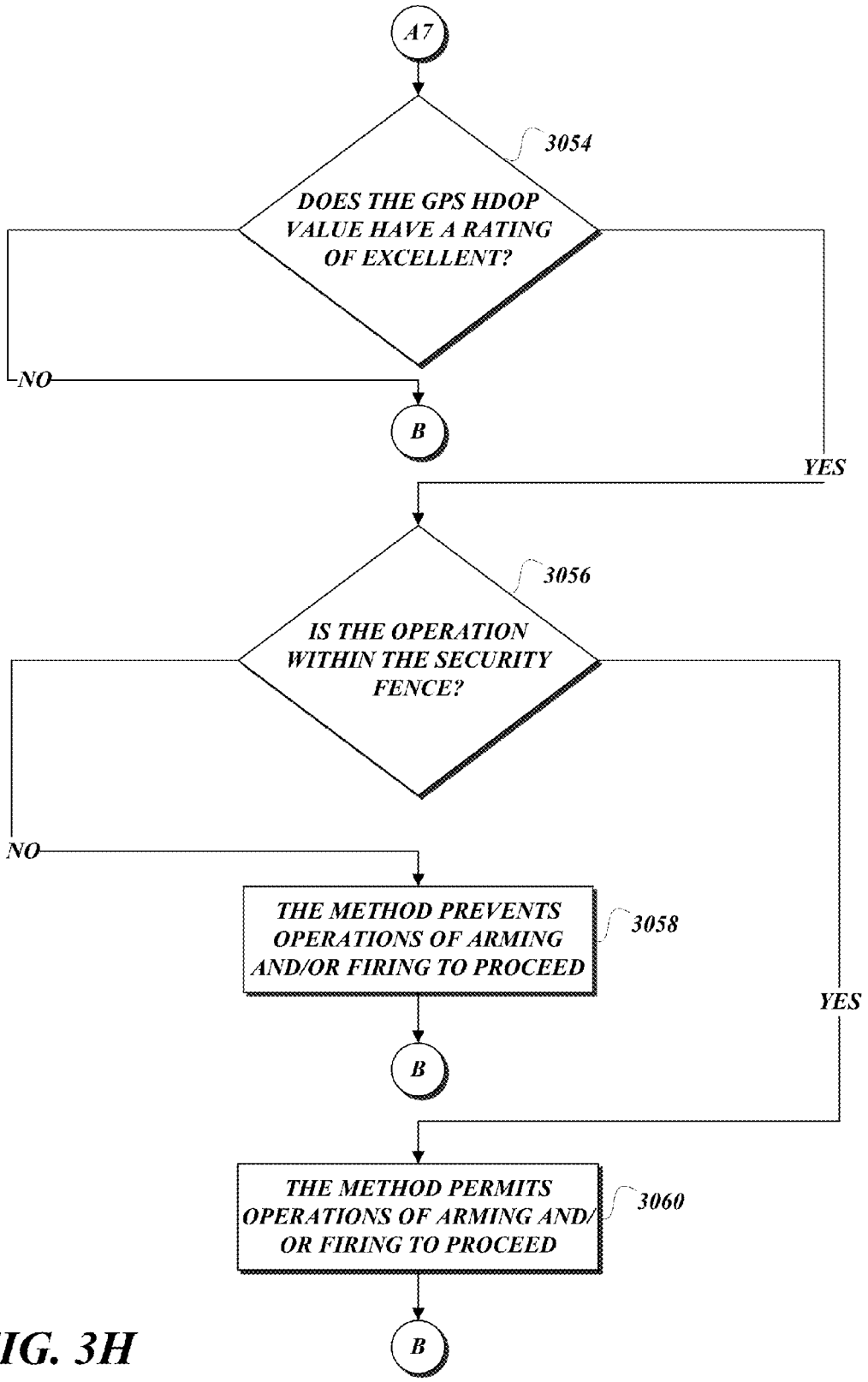
Figure 3I:
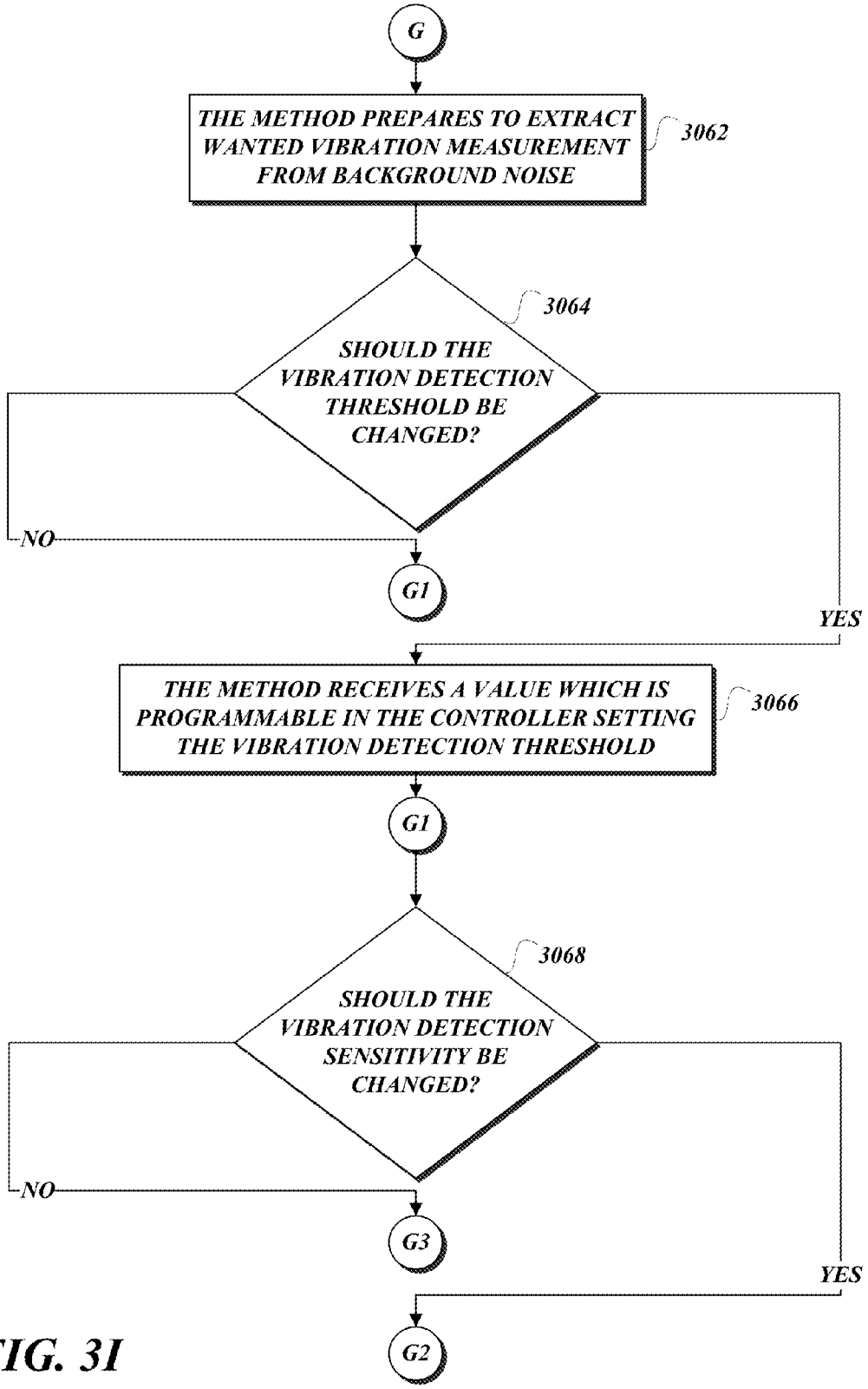
Figure 3J:
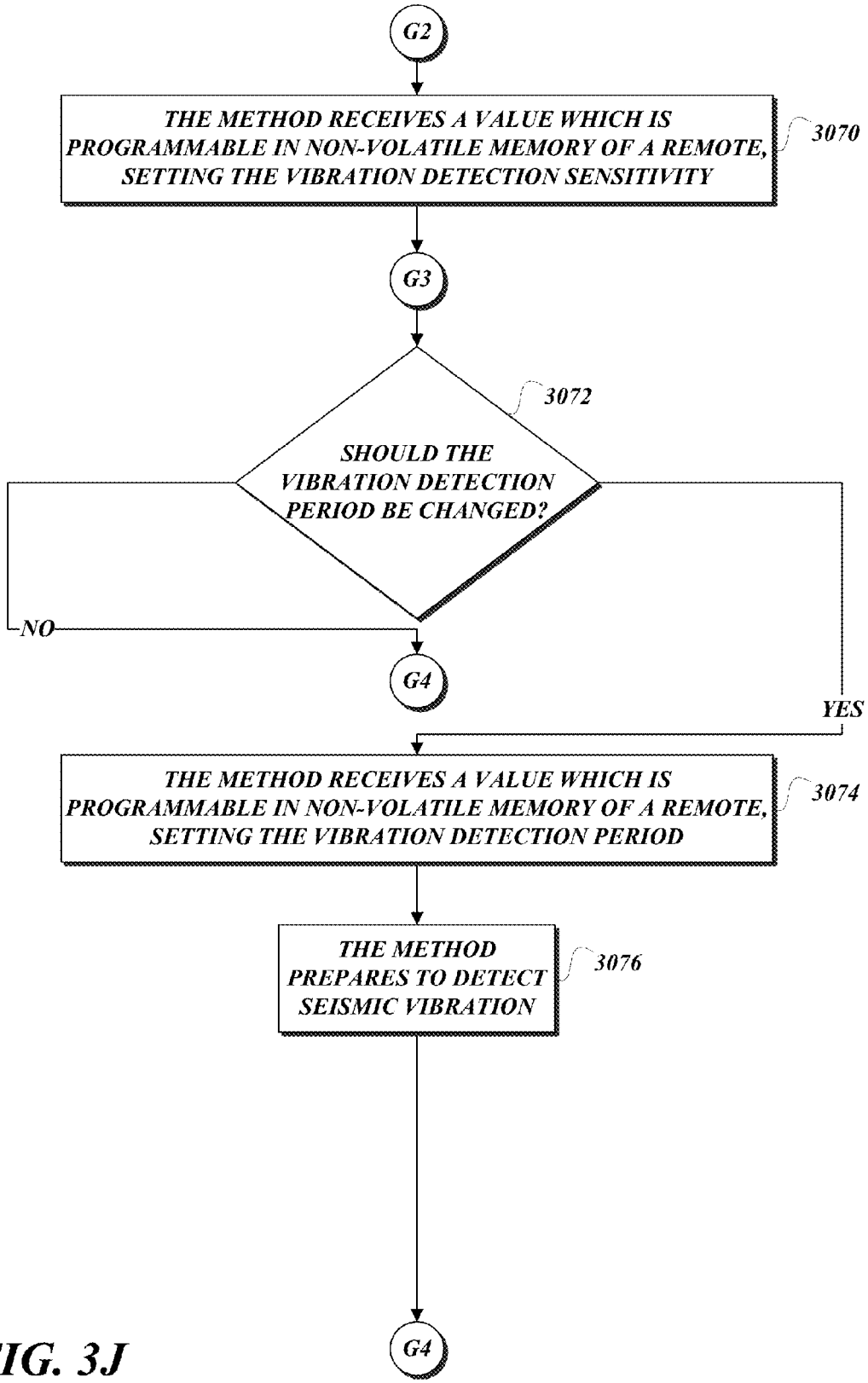
Figure 3K:
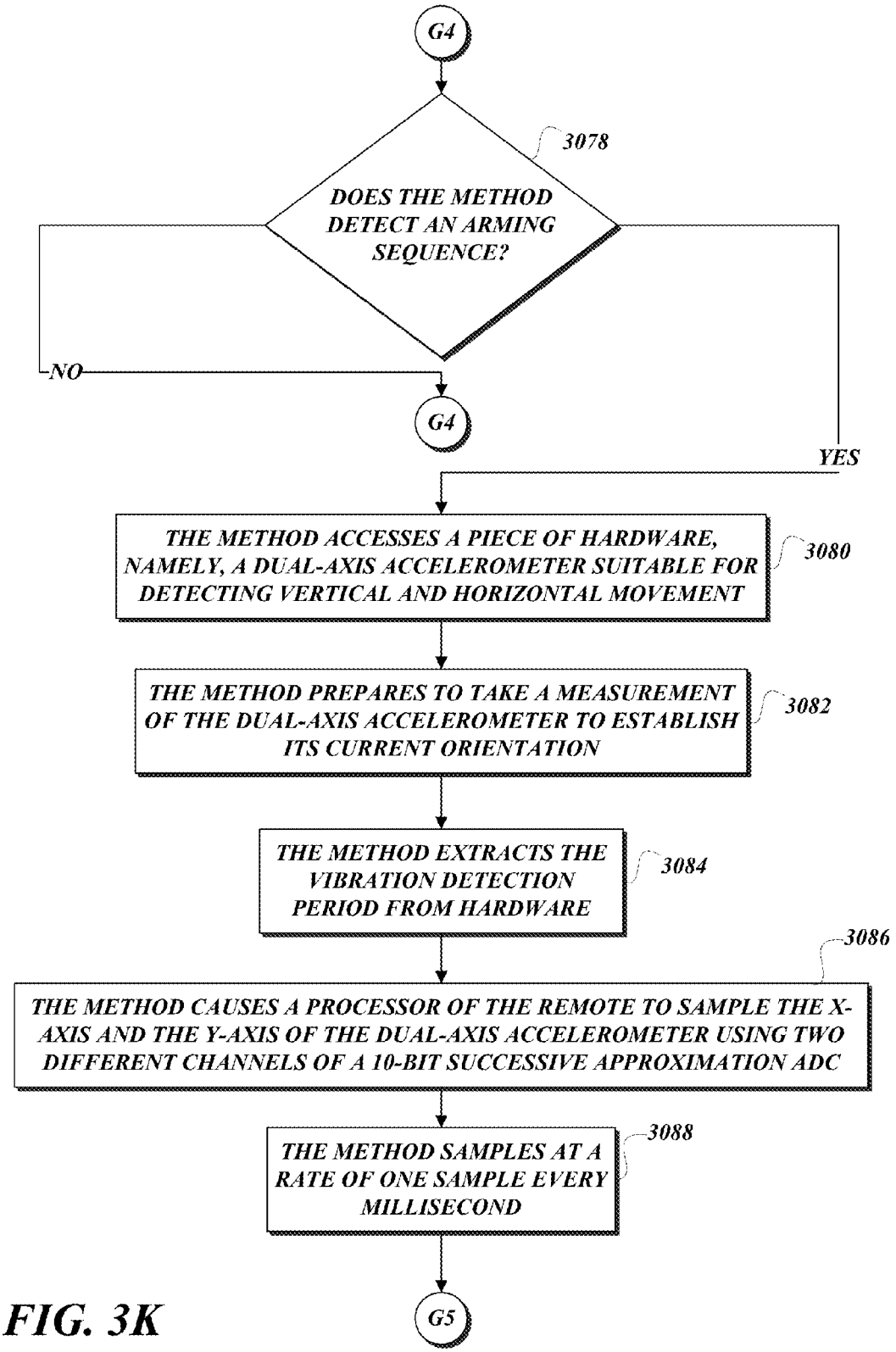
Figure 3L:
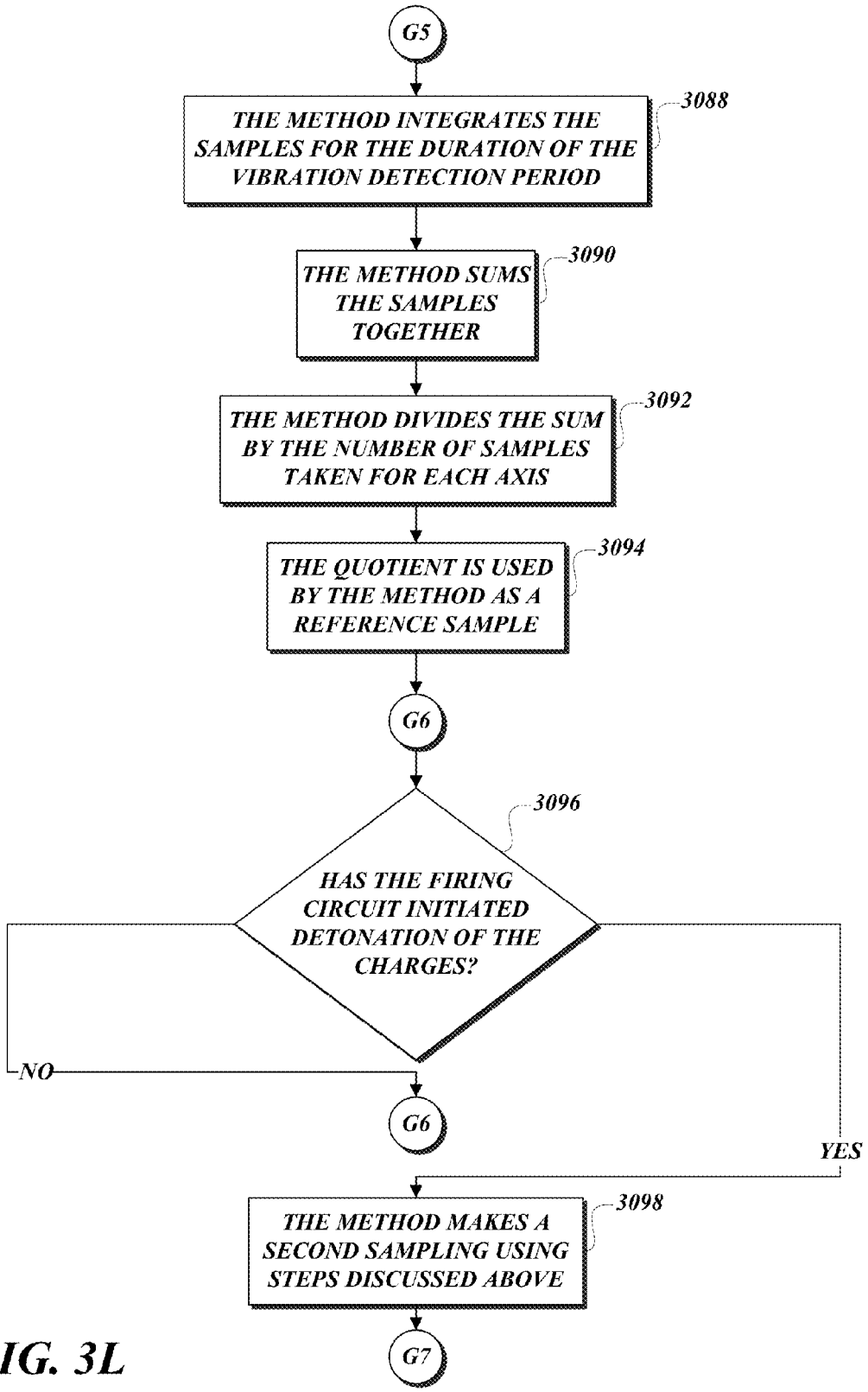
Figure 3M:
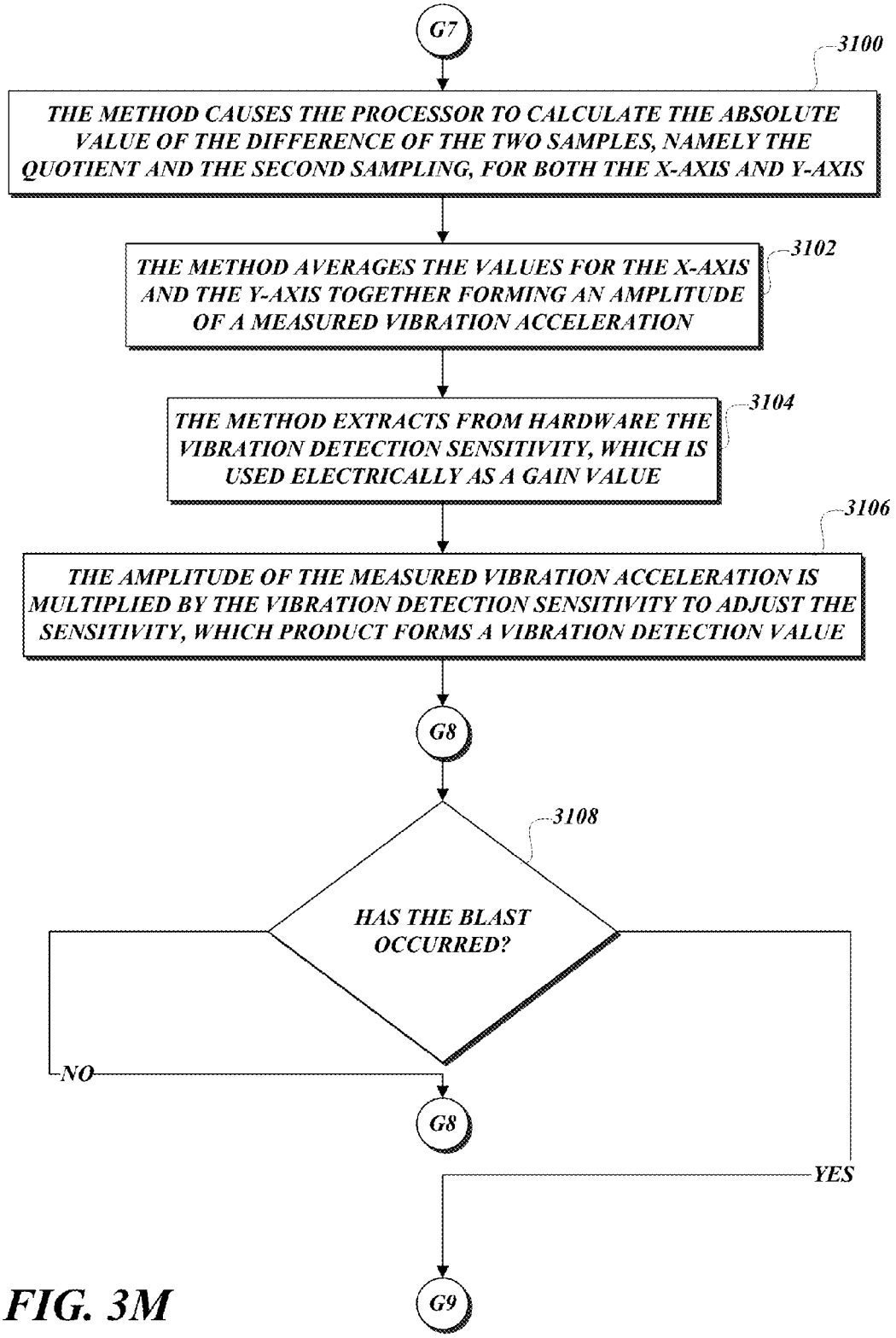
Figure 3N:
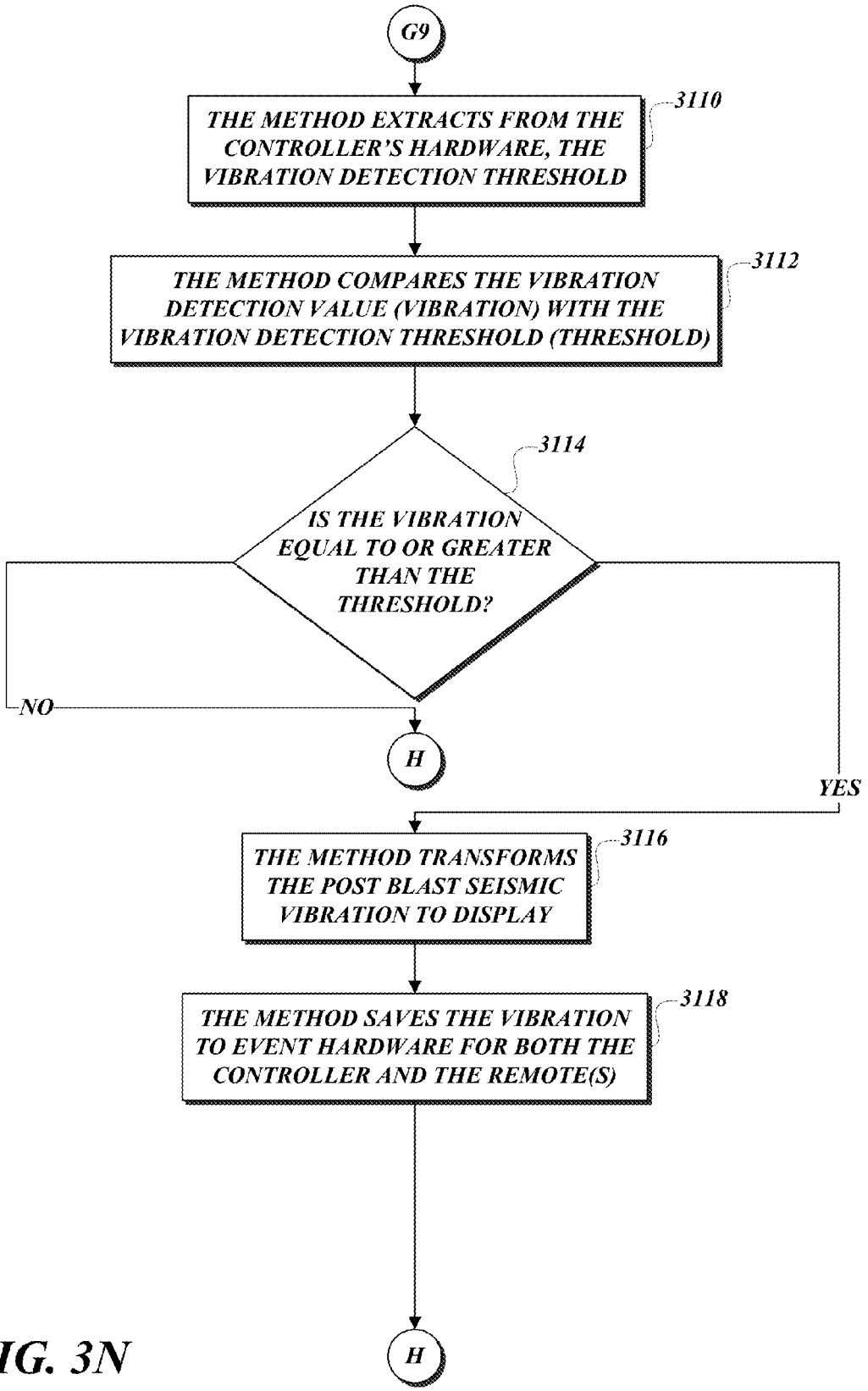
Figure 3O:
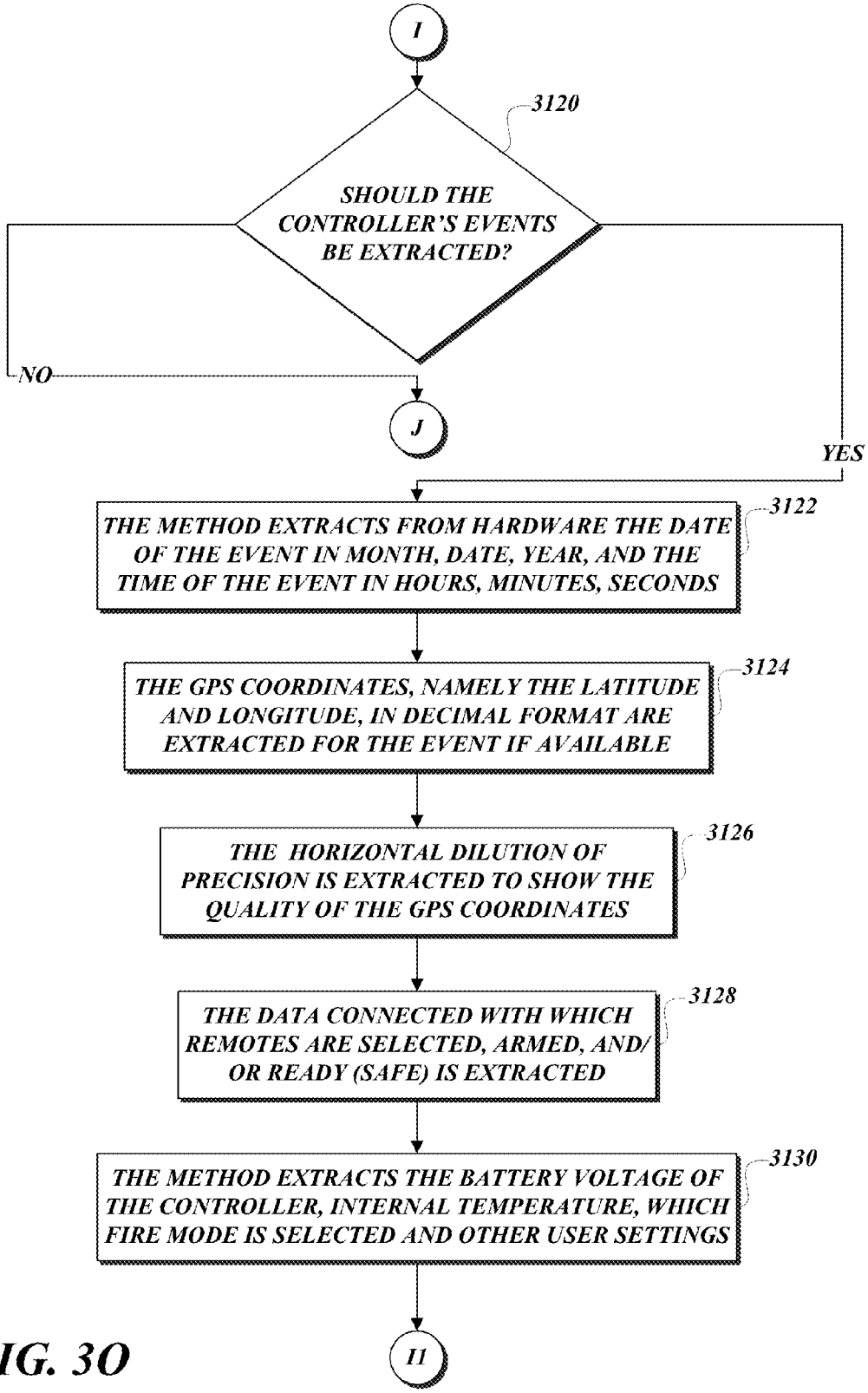
Figure 3P:
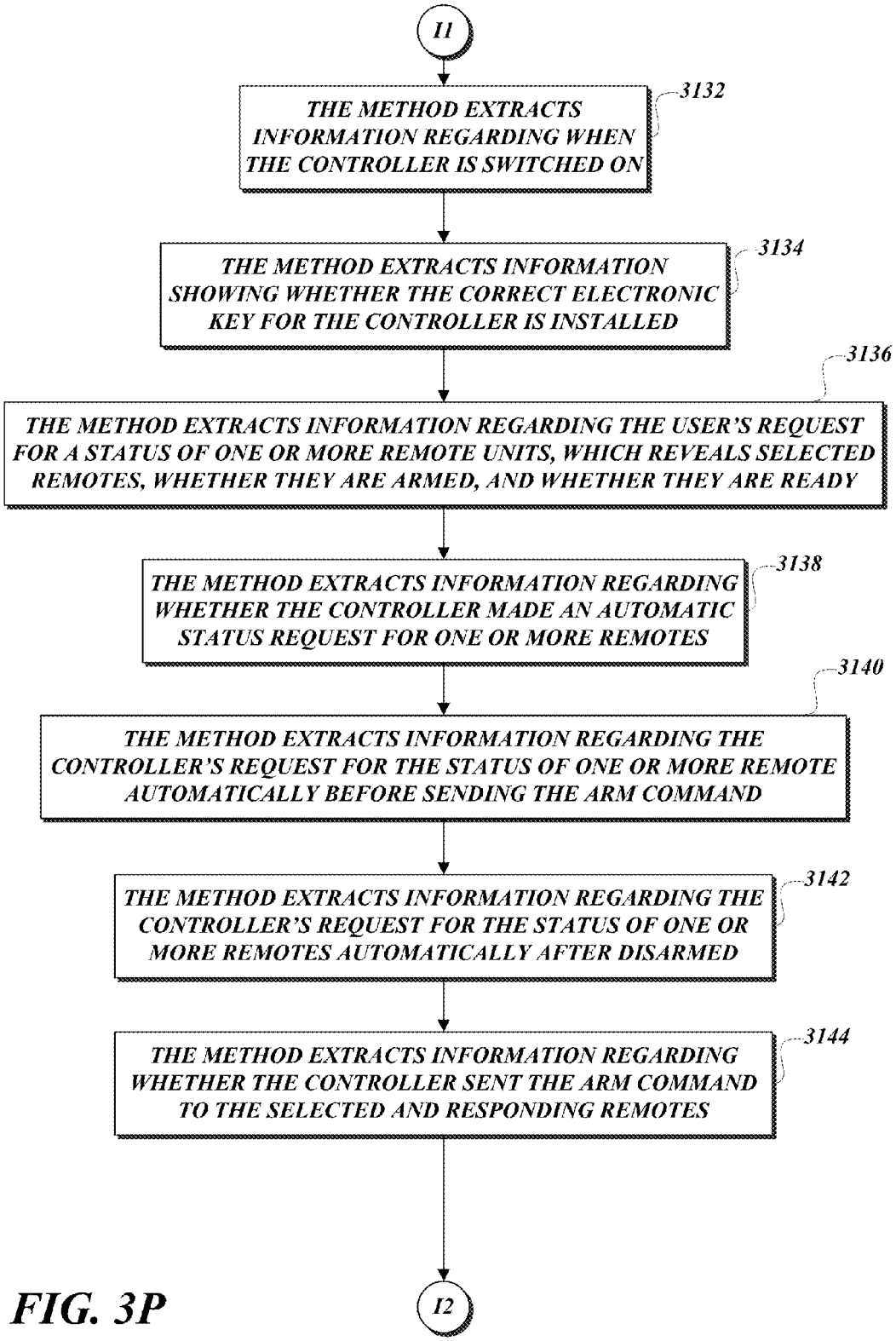
Figure 3Q:
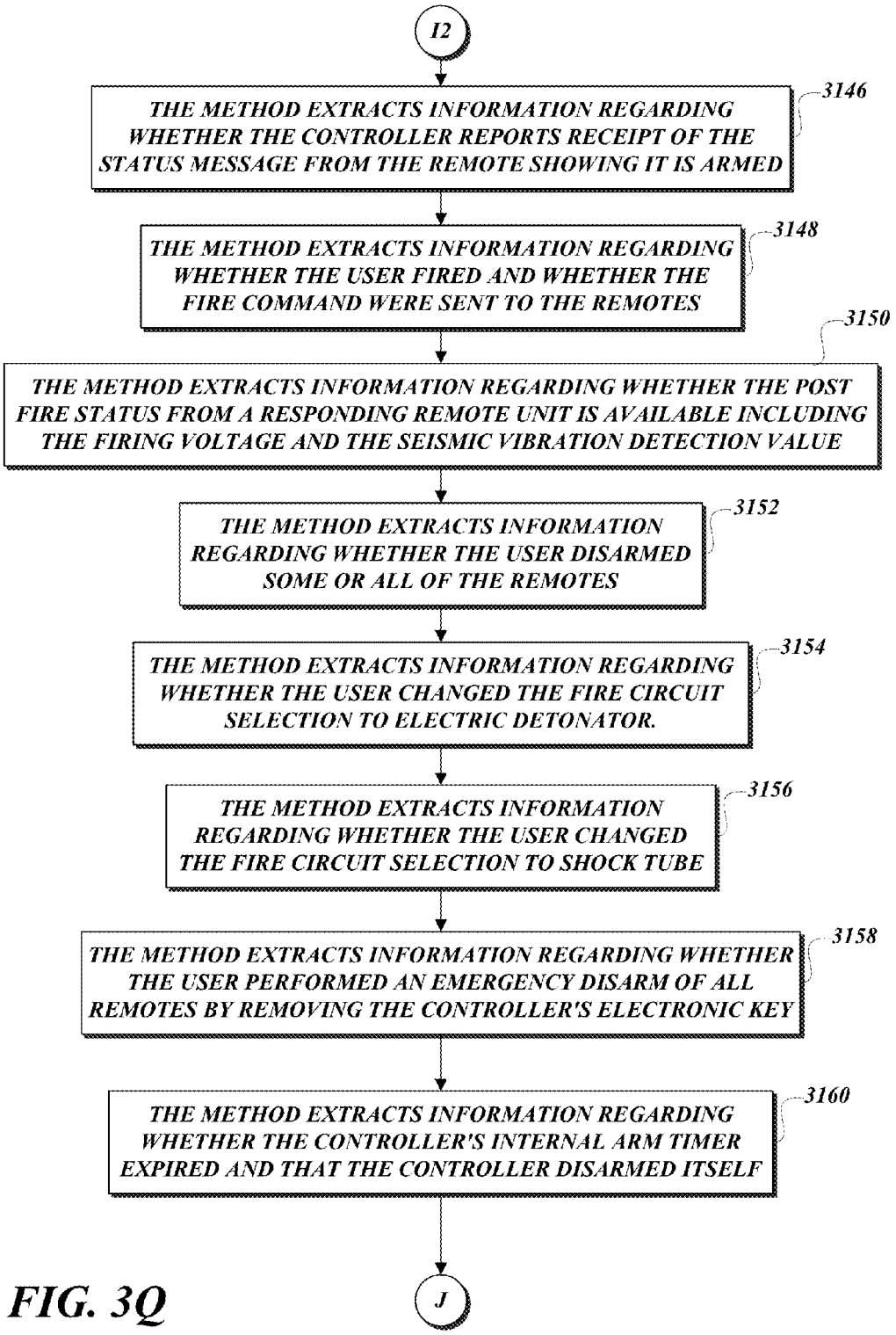
Figure 3R:
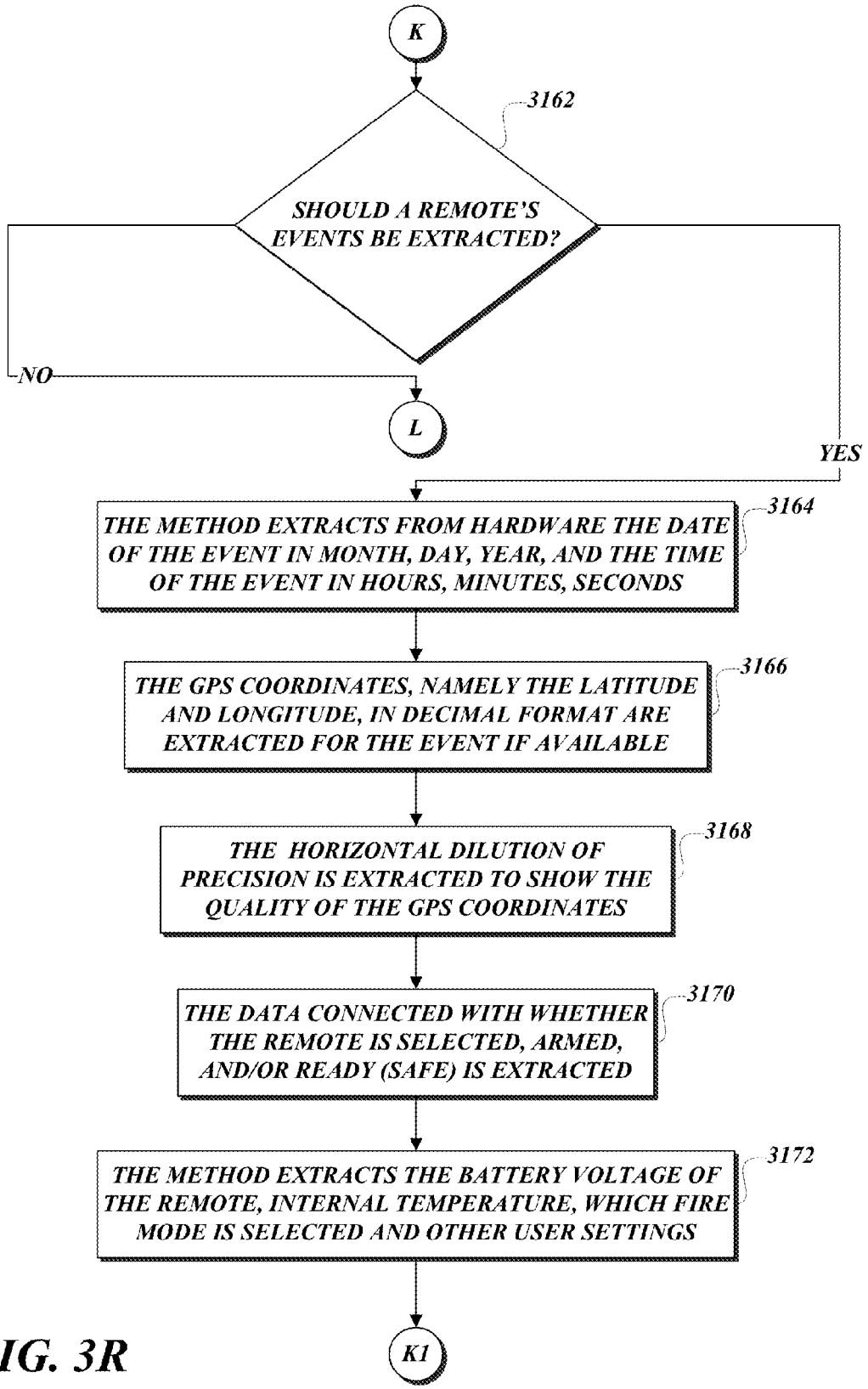
Figure 3S:
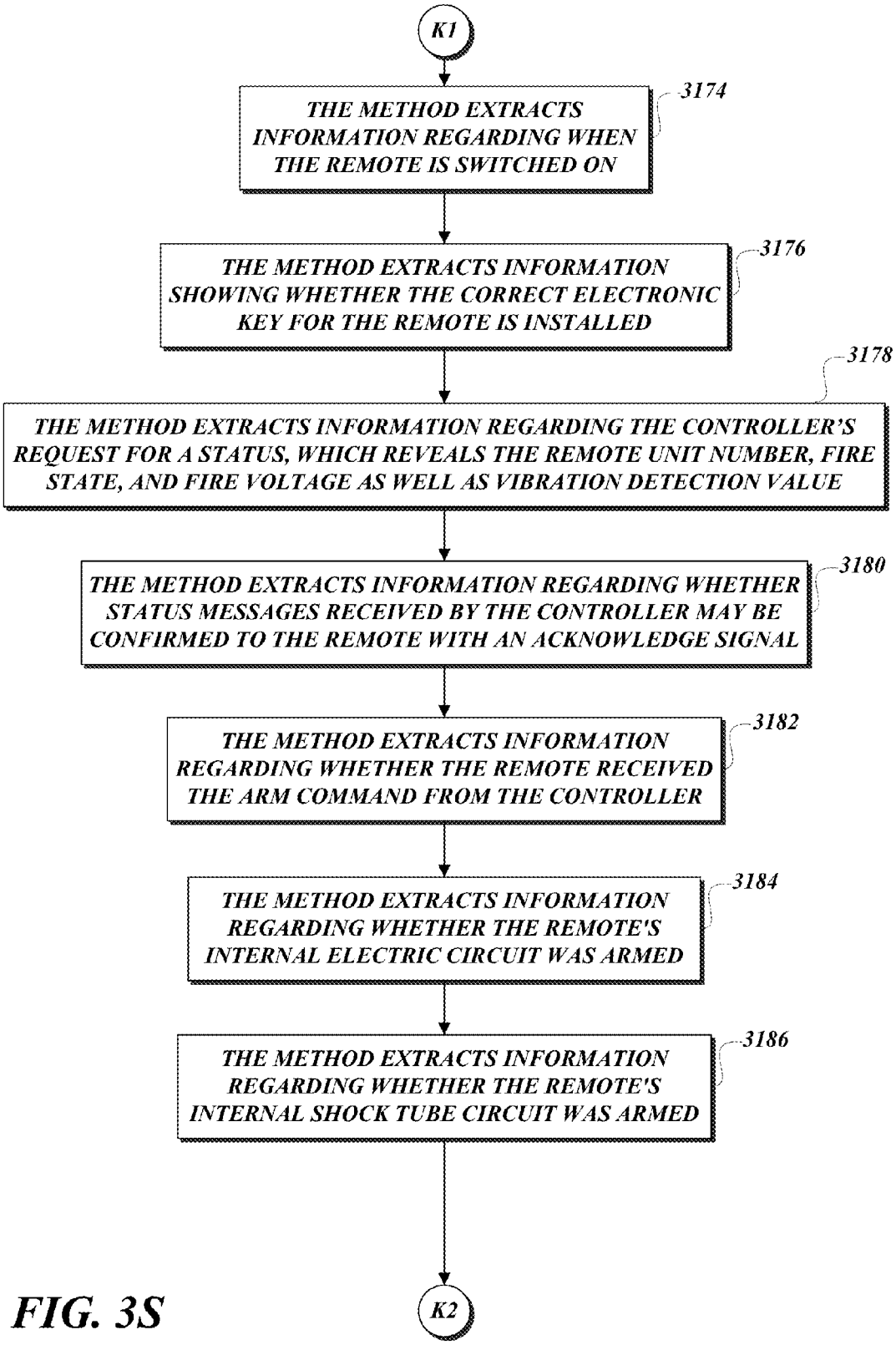
Figure 3T:
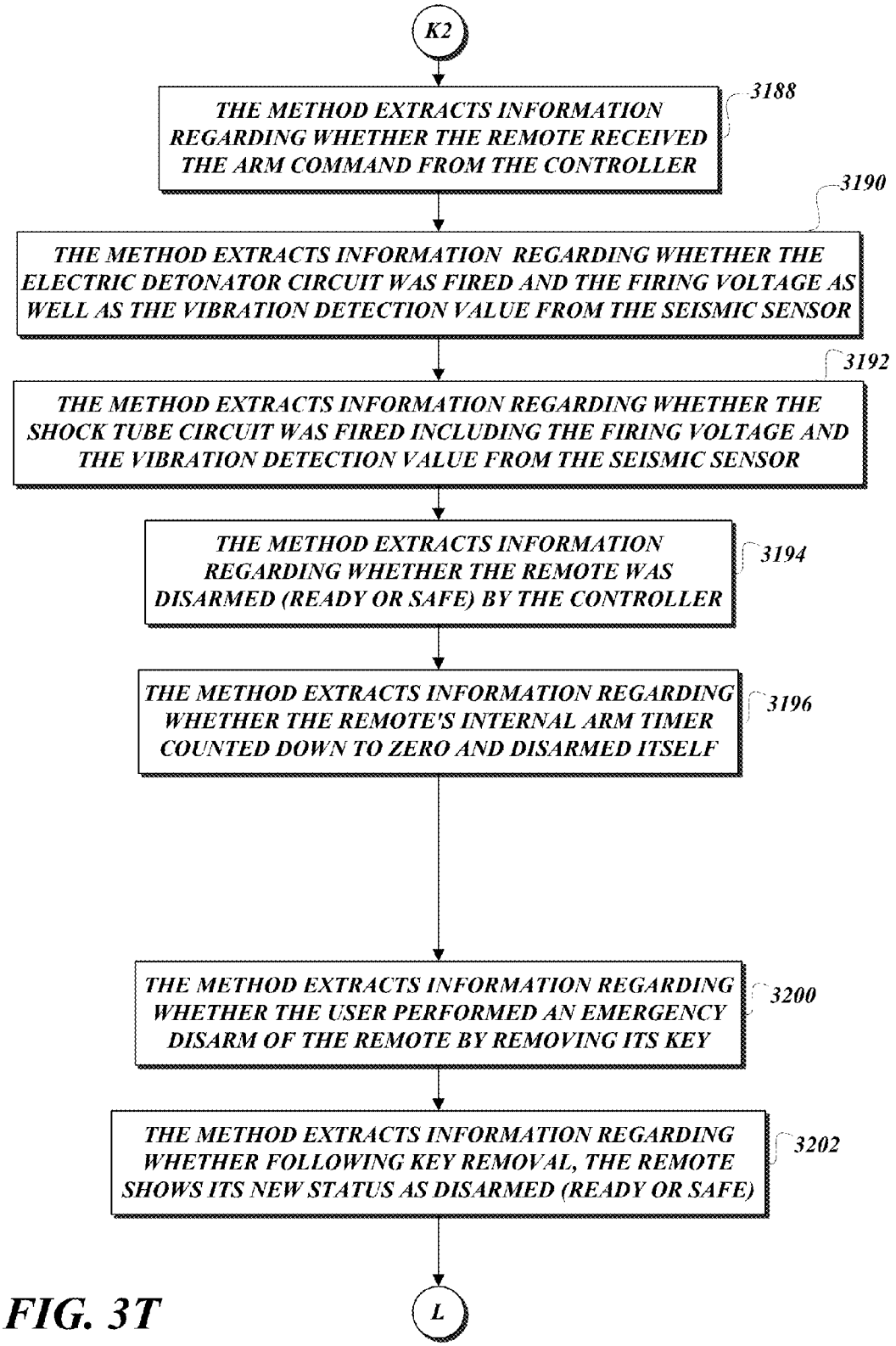

FIGS. 3A-3T are process diagrams implementing an exemplary method 3000. From a start block, the method 3000 proceeds to a set of method steps defined between a continuation terminal ("terminal A") and another continuation terminal ("terminal B"). The set of method steps 3002 sets a security fence for a controller, a remote, or both, within which operations are allowed. From terminal A (FIG. 3C), the method proceeds to decision block 3014. A test is performed at decision block 3014 to determine whether a security fence should be set up for the controller. If the answer to the test at decision block 3014 is No, the method continues to another continuation termination ("terminal A3"). Otherwise, if the answer to the test at decision block 3014 is Yes, the method proceeds to block 3016 where the method prepares to set an area of operation for the controller. The method then continues to another continuation terminal ("terminal A1"). From terminal A1 (FIG. 3C), the method proceeds to decision block 3018 where a test is performed to determine whether the controller is located at a desired firing point. If the answer to the test at decision block 3018 is No, the method continues to terminal A1 and loops back to decision block 3018 where processing is repeated. Otherwise, if the answer to the test at decision block 3018 is Yes, the method proceeds to another continuation terminal ("terminal A2").

From terminal A2 (FIG. 3D), the method 3000 proceeds to block 3020 where the method receives security authentication, such as a PIN code, to set the security fence for the controller. The method continues to decision block 3022 where a test is performed to determine whether the security authentication was authenticated. If the answer to the test at decision block 3022 is No, the method proceeds to terminal A2 and skips back to block 3020 where the above-identified processing steps are repeated. If the answer to the test at decision block 3022 is Yes, the method proceeds to block 3024 where the method receives instructions to lock the current position of the controller into non-volatile memory. At block 3026, the method receives a radius of operation (such as in meters and so on) of which the center is located at the current position of the controller. At block 3028, the method enables the security fence for the controller. The method then continues to terminal A3.

From terminal A3 (FIG. 3E), the method proceeds to decision block 3030 where a test is performed to determine whether a security fence should be set for a remote. If the answer to the test at decision block 3030 is No, the method continues to another continuation terminal ("terminal A6"). Otherwise, if the answer to the test at decision block 3030 is Yes, the method proceeds to block 3032 where the method prepares to set an area of operation for the remote. The method then continues to another continuation terminal ("terminal A4"). From terminal A4 (FIG. 3E), the method proceeds to decision block 3034 where a test is performed to determine whether the remote is located at a desired firing point. If the answer to the test at decision block 3034 is No, the method proceeds to terminal A4 and skips back to decision block 3034 where its processing is repeated. Otherwise, if the answer to the test at decision block 3034 is Yes, the method proceeds to block 3036 where the method receives security authentication, such as a PIN code, to set the security fence for the remote. The method then continues to another continuation terminal ("terminal A5").

From terminal A5 (FIG. 3F), the method proceeds to decision block 3038 where a test is performed to determine whether the security authentication was authenticated. If the answer to the test at decision block 3038 is No, the method proceeds to terminal A2 and skips back to block 3020 where the above-identified processing steps are repeated. Otherwise, if the answer to the test at decision block 3038 is Yes, the method proceeds to block 3040 where the method receives instructions to lock the current position of the remote into non-volatile memory. The method then proceeds to block 3042 where the method receives a radius of operation (such as in meters and so on) of which the center is located at the current position of the remote. At block 3044, the method enables the security fence for the remote. The method then proceeds to decision block 3046 where another test is performed to determine whether there is another remote to set the security fence. If the answer to the test at decision block 3046 is No, the method proceeds to another continuation terminal ("terminal A6"). Otherwise, if the answer to the test at decision block 3046 is Yes, the method proceeds to terminal A3 and skips back to decision block 3030 where the above-identified processing steps are repeated.

From terminal A6 (FIG. 3G), the method proceeds to decision block 3048 where a test is performed to determine whether the security fence is enabled. If the answer to the test at decision block 3048 is No, the method proceeds to terminal B. Otherwise, if the answer to the test at decision block 3048 is Yes, the method proceeds to decision block 3050 where another test is performed to determine whether GPS is enabled. If the answer to the test at decision block 3050 is No, the method proceeds to terminal B. Otherwise, if the answer to the test at decision block 3050 is Yes, the method proceeds to decision block 3052 where another test is performed to determine whether the GPS signal is present. If the answer to the test at decision block 3052 is No, the method proceeds to terminal B. Otherwise, if the answer to the test at decision block 3052 is Yes, the method proceeds to another continuation terminal ("terminal A7").

From terminal A7 (FIG. 3H), the method proceeds to yet another decision block 3054 where a test is performed to determine whether the GPS HDOP value has a rating high enough to ensure confidence of accuracy (i.e., an excellent rating). If the answer to the test at decision block 3054 is No, the method proceeds to terminal B. Otherwise, if the answer to the test at decision block 3054 is Yes, the method proceeds to another decision block 3056 where a test is performed to determine whether the operation is within the security fence (i.e., within the set radius). If the answer to the test at decision block 3056 is No, the method proceeds to block 3058 where the method prevents operations of arming and/or firing to proceed. The method then continues to terminal B. Otherwise, if the answer to the test at decision block 3056 is Yes, the method proceeds to block 3060 where the method permits operations of arming and/or firing to proceed. The method then continues to terminal B.

From terminal B (FIG. 3A), the method 3000 proceeds to a set of method steps 3004 defined between a continuation terminal ("terminal C") and another continuation terminal ("terminal D"). The set of method steps 3004 actuate a countdown timer. From terminal D (FIG. 3A), the method proceeds to a set of method steps defined between a continuation terminal ("terminal E") and another continuation terminal ("terminal F"). The set of method steps 3006 actuate sequential firing hardware. From terminal F (FIG. 3B), the method proceeds to a set of method steps 3008 defined between a continuation terminal ("terminal G") and another continuation terminal ("terminal H"). The set of method steps 3008 actuate seismic detection hardware.

From terminal G (FIG. 3I), the method 3000 proceeds to block 3062 where the method prepares to extract wanted vibration measurement from background noise. The method then proceeds to decision block 3064 where a test is performed to determine whether the vibration detection threshold should be changed. If the answer to the test at decision block 3064 is No, the method proceeds to another continuation terminal ("terminal G1"). Otherwise, if the answer to the test at decision block 3064 is Yes, the method proceeds to block 3066 where the method receives a value which is programmable in the controller setting the vibration detection threshold. The method then continues to terminal G1. From terminal G1 (FIG. 3I), the method proceeds to decision block 3068 where a test is performed to determine whether the vibration detection sensitivity should be changed. If the answer to the test at decision block 3068 is No, the method proceeds to another continuation terminal ("terminal G3"). Otherwise, if the answer to the test at decision block 3068 is Yes, the method proceeds to another continuation terminal ("terminal G2").

From terminal G2 (FIG. 3J), the method 3000 proceeds to block 3070 where the method receives a value which is programmable in the non-volatile memory of a remote, setting the vibration detection sensitivity. The method then continues to terminal G3 and further proceeds to decision block 3072 where a test is performed to determine whether the vibration detection period should be changed. If the answer to the test at decision block 3072 is No, the method continues to another continuation terminal ("terminal G4"). Otherwise, if the answer to the test at decision block 3072 is Yes, the method proceeds to block 3074 where the method receives a value which is programmable in the non-volatile memory of a remote, setting the vibration detection period. At block 3076, the method prepares to detect seismic vibration. The method then continues to terminal G4.

From terminal G4 (FIG. 3K), the method proceeds to decision block 3078 where a test is performed to determine whether the method detects an arming sequence. If the answer to the test at decision block 3078 is No, the method proceeds to terminal G4 and skips back to decision block 3078 where its processing is repeated. Otherwise, if the answer to the test at decision block 3078 is Yes, the method proceeds to block 3080 where the method accesses a piece of hardware, namely, a dual-axis accelerometer suitable for detecting vertical and horizontal movement. At block 3082, the method prepares to take a measurement of the dual-axis accelerometer to establish its current orientation. At block 3084, the method extracts the vibration detection period from the hardware. At block 3086, the method causes a processor of the remote to sample the X-axis and the Y-axis of the dual-axis accelerometer using two different channels of a 10-bit successive approximation analog-to-digital converter. At block 3088, the method samples at a rate of one sample every millisecond. The method then continues to another continuation terminal ("terminal G5").

From terminal G5 (FIG. 3L), the method proceeds to block 3088 where the method integrates the samples for the duration of the vibration detection period. At block 3090, the method sums the samples together. At block 3092, the method divides the sum by the number of samples taken for each axis. At block 3094, the quotient is used by the method as a reference sample. The method then continues to another continuation terminal ("terminal G6"). From terminal G6 (FIG. 3L), the method proceeds to decision block 3096 where a test is performed to determine whether the firing circuit has initiated detonation of the charges. If the answer to the test at decision block 3096 is No, the method continues to terminal G6 and skips back to decision block 3096 and its processing is repeated. If the answer to the test at decision block 3096 is Yes, the method proceeds to block 3098 where the method makes a second sampling using steps discussed above. The method then continues to another continuation terminal ("terminal G7").

At terminal G7 (FIG. 3M), the method proceeds to block 3100 where the method causes the processor to calculate the absolute value of the difference of the two samples, namely, the quotient and the second sampling, for both the X-axis and Y-axis. At block 3102, the method averages the values for the X-axis and the Y-axis together forming an amplitude of a measured vibration acceleration. At block 3104, the method extracts from hardware the vibration detection sensitivity, which is used electrically as a gain value. At block 3106, the amplitude of the measured vibration acceleration is multiplied by the vibration detection sensitivity to adjust the sensitivity, of which the product forms a vibration detection value.

The method 3000 continues to another continuation terminal ("terminal G8"). From terminal G8 (FIG. 3M), the method proceeds to decision block 3108 where a test is performed to determine whether the blast has occurred. If the answer to the test at decision block 3108 is No, the method proceeds to terminal G8 and skips back to decision block 3108 where its processing is repeated. Otherwise, if the answer to the test at decision block 3108 is Yes, the method proceeds to another continuation terminal ("terminal G9").

From terminal G9 (FIG. 3N), the method 3000 proceeds to block 3110 where the method extracts, from the controller's hardware, the vibration detection threshold. At block 3112, the method compares the vibration detection value (vibration) with the vibration detection threshold (threshold). The method then continues to decision block 3114 where a test is performed to determine whether the vibration is equal to or greater than the threshold. If the answer to the test at decision block 3114 is No, the method proceeds to terminal H. Otherwise, if the answer to the test at decision block 3114 is Yes, the method proceeds to block 3116 where the method transforms the post-blast seismic vibration to display. At block 3118, the method saves the vibration to the event hardware of both the controller and the remote(s). The method then continues to terminal H.

From terminal H, the method 3000 proceeds to a set of method steps 3010 defined between a continuation terminal ("terminal I") and another continuation terminal ("terminal J"). The set of method steps 3010 captures events of a controller with GPS information. From terminal I (FIG. 3O), the method proceeds to decision block 3120 where a test is performed to determine whether the controller's events should be extracted. If the answer to the test at decision block 3120 is No, the method proceeds to terminal J. Otherwise, if the answer to the test at decision block 3120 is Yes, the method proceeds to block 3122 where the method extracts from hardware the date of the event in month, day, and year; and the time of the event in hours, minutes, and seconds. At block 3124, the GPS coordinates, namely the latitude and longitude, in decimal format are extracted for the event (if available). At block 3126, the horizontal dilution of precision is extracted to show the quality of the GPS coordinates. At block 3128, the data connected with remotes that are selected, armed, and/or ready (safe) is extracted. At block 3130, the method extracts the battery voltage of the controller, internal temperature, the fire mode selected and other user settings. The method then continues to another continuation terminal ("terminal I1").

From terminal I1 (FIG. 3P), the method proceeds to block 3132 where the method extracts information regarding when the controller is switched on. At block 3134, the method extracts information showing whether the correct electronic key for the controller is installed. At block 3136, the method extracts information regarding the user's request for a status of one or more remote units, which reveals selected remotes, whether they are armed, and whether they are ready. At block 3138, the method extracts information regarding whether the controller made an automatic status request for one or more remotes. At block 3140, the method extracts information regarding the controller's request for the status of one or more remotes automatically before sending the arm command. At block 3142, the method extracts information regarding the controller's request for the status of one or more remotes automatically after being disarmed (caused by various options including a disarm command or expiry of an internal arm timer). At block 3144, the method extracts information regarding whether the controller sent the arm command to the selected and responding remotes. The method then continues to another continuation terminal ("terminal I2").

From terminal I2 (FIG. 3Q), the method proceeds to block 3146 where the method extracts information regarding whether the controller reports receipt of the status message from the remote showing it is armed. At block 3148, the method extracts information regarding whether the user fired and whether the fire command was sent to the remotes. At block 3150, the method extracts information regarding whether the post-fire status from a responding remote unit is available, including the firing voltage and the seismic vibration detection value (detected by one or more sensors). At block 3152, the method extracts information regarding whether the user disarmed some or all of the remotes. At block 3154, the method extracts information regarding whether the user changed the fire circuit selection to electric detonator. At block 3156, the method extracts information regarding whether the user changed the fire circuit selection to shock tube. At block 3158, the method extracts information regarding whether the user performed an emergency disarm of all remotes by removing the controller's electronic key. At block 3160, the method extracts information regarding whether the controller's internal arm timer expired and the controller disarmed itself. The method then continues to terminal J.

From terminal J (FIG. 3B), the method proceeds to a set of method steps 3012 defined between a continuation terminal ("terminal K") and another continuation terminal ("terminal L"). The set of method steps 3012 captures events of a remote with GPS information. From terminal K (FIG. 3R), the set of method steps 3000 proceeds to decision block 3162 where a test is performed to determine whether a remote's events should be extracted. If the answer to the test at decision block 3162 is No, the method proceeds to terminal L and terminates execution. Otherwise, if the answer to the test at decision block 3162 is Yes, the method proceeds to block 3164, where the method extracts from hardware the date of the event in month, day, and year; and the time of the event in hours, minutes, and seconds. At block 3166, the GPS coordinates, namely the latitude and longitude, in decimal format are extracted for the events if available. At block 3168, the horizontal dilution of precision is extracted to show the quality of the GPS coordinates. At block 3170, the data connected with whether the remote is selected, armed, and/or ready (safe) is extracted. At block 3172, the method extracts the battery voltage of the remote, internal temperature, the fire mode selected, and other user settings. The method then continues to another continuation terminal ("terminal K1").

From terminal K1 (FIG. 3S), the method proceeds to block 3174, where the method extracts information regarding when the remote is switched on. At block 3176, the method extracts information showing whether the correct electronic key for the remote is installed. At block 3178, the method extracts information regarding the controller's request for status, which reveals the remote unit number, fire state, and fire voltage as well as vibration detection value. At block 3180, the method extracts information regarding whether status messages received by the controller may be confirmed by the remote with an acknowledge signal. At block 3182, the method extracts information regarding whether the remote received the arm command from the controller. At block 3184, the method extracts information regarding whether the remote's internal electric circuit was armed. At block 3186, the method extracts information regarding whether the remote's internal shock tube circuit was armed. The method then continues to another continuation terminal ("terminal K2").

From terminal K2 (FIG. 3T), the method proceeds to block 3188 where the method extracts information regarding whether the remote received the arm command from the controller. At block 3190, the method extracts information regarding whether the electric detonator circuit was fired and the firing voltage as well as the vibration detection value from the seismic sensor. At block 3192, the method extracts information regarding whether the shock tube circuit was fired, including the firing voltage and the vibration detection value from the seismic sensor. At block 3194, the method extracts information regarding whether the remote was disarmed (ready or safe) by the controller. At block 3196, the method extracts information regarding whether the remote's internal arm timer counted down to zero and disarmed itself. At block 3200, the method extracts information regarding whether the user performed an emergency disarm of the remote by removing its key. At block 3202, the method extracts information regarding whether following key removal, the remote shows its new status as disarmed (ready or safe). The method then continues to terminal L and terminates execution.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method comprising:

allowing operations of a controller if the operations are within a first security fence;

allowing operations of a remote if the operations are within a second security fence;

detecting seismic vibration after a blast has occurred;

storing retrievable events of a controller in a first non-volatile memory; and storing retrievable events of a remote in a second non-volatile memory.

2. The method of claim 1, further comprising receiving instructions to lock a position of the controller, locking the position of the controller into non-volatile memory, receiving a first radius of operation, and enabling the first security fence.

3. The method of claim 1, further comprising receiving instructions to lock a position of the remote, locking the position of the remote into non-volatile memory, receiving a second radius of operation, and enabling the second security fence.

4. The method of claim 1, wherein allowing operations of a controller includes determining whether a GPS signal is present and whether high dilution of precision has an excellent rating.

5. The method of claim 1, wherein allowing operations of a remote includes determining whether a GPS signal is present and whether high dilution of precision has an excellent rating.

6. The method of claim 1, further comprising actuating a countdown timer.

7. The method of claim 1, further comprising actuating sequential firing.

8. The method of claim 1, further comprising setting a vibration detection threshold, setting vibration detection sensitivity, and setting a vibration detection period.

9. The method of claim 8, further comprising calculating an amplitude of a measured vibration acceleration using the vibration detection period and multiplying the amplitude of the measured vibration acceleration by the vibration detection sensitivity, the product of which forms a vibration detection value.

10. The method of claim 1, further comprising comparing the vibration detection value with the vibration detection threshold and transforming seismic vibration to display if the vibration detection value is greater than or equal to the vibration detection threshold.

11. The method of claim 1, wherein storing retrievable events of a controller includes storing the date of the event, the GPS coordinates, the horizontal dilution of precision, the battery voltage of the controller, internal temperature, the fire mode is selected, information regarding when the controller is switched on, whether the correct electronic key for the controller is installed, the user's request for a status of one or more remotes, selected remotes, whether they are armed, whether they are ready, whether the controller made an automatic status request for one or more remotes, the controller's request for the status of one or more remotes automatically before sending the arm command, the controller's request for the status of one or more remotes automatically after being disarmed, whether the controller sent the arm command to the selected and responding remotes, whether the controller reports receipt of the status message from the remote showing it is armed, whether the user fired and whether the fire command was sent to the remotes, whether the post fire status from a responding remote unit is available including the firing voltage and the seismic vibration detection value, whether the user disarmed some or all of the remotes, whether the user changed the fire circuit selection to electric detonator, whether the user changed the fire circuit selection to shock tube, whether the user performed an emergency disarm of all remotes by removing the controller's electronic key, and whether the controller's internal arm timer expired and that the controller disarmed itself.

12. The method of claim 1, wherein storing retrievable events of a remote includes storing the date of the event, the GPS coordinates, the horizontal dilution of precision, whether the remote is selected, armed, and/or ready, the battery voltage of the remote, internal temperature, the fire mode selected, when the remote is switched on, whether the correct electronic key for the remote is installed, the controller's request for a status, which reveals the remote unit number, fire state, and fire voltage as well as vibration detection value, whether status messages received by the controller may be confirmed to the remote with an acknowledge signal, whether the remote received the arm command from the controller, whether the remote's internal electric circuit was armed, whether the remote's internal shock tube circuit was armed, whether the remote received the arm command from the controller, whether the electric detonator circuit was fired and the firing voltage as well as the vibration detection value from the seismic sensor, whether the shock tube circuit was fired including the firing voltage and the vibration detection value from the seismic sensor, whether the remote was disarmed by the controller, whether the remote's internal arm timer counted down to zero and disarmed itself, whether the remote's internal electric circuit was armed, whether the user performed an emergency disarm of the remote by removing its key, and whether following key removal, the remote shows its new status as disarmed.

* * * * *